US010400477B2

(12) United States Patent
Moon et al.

(10) Patent No.: US 10,400,477 B2
(45) Date of Patent: Sep. 3, 2019

(54) ELECTRONIC DEADBOLT

(71) Applicant: TOWNSTEEL, INC., City of Industry, CA (US)

(72) Inventors: Charles W. Moon, Colorado Springs, CO (US); Ernst K. Mitchell, Sterling Heights, MI (US); Sybor Ma, La Puente, CA (US)

(73) Assignee: Townsteel, Inc., City of Industry, CA (US)

( * ) Notice: Subject to any disclaimer, the term of this patent is extended or adjusted under 35 U.S.C. 154(b) by 653 days.

(21) Appl. No.: 15/045,029

(22) Filed: Feb. 16, 2016

(65) Prior Publication Data

US 2017/0122007 A1 May 4, 2017

Related U.S. Application Data

(60) Provisional application No. 62/250,374, filed on Nov. 3, 2015.

(51) Int. Cl.
*E05B 47/00* (2006.01)
*E05B 47/02* (2006.01)
(Continued)

(52) U.S. Cl.
CPC ..... *E05B 47/0012* (2013.01); *E05B 47/026* (2013.01); *E05B 63/0017* (2013.01);
(Continued)

(58) Field of Classification Search
CPC ..... E05B 15/004; Y10T 292/1021
(Continued)

(56) References Cited

U.S. PATENT DOCUMENTS 3,791,180 A 2/1974 Doyle
3,875,772 A 4/1975 Ebersman et al.
(Continued)

FOREIGN PATENT DOCUMENTS

FR 3004207 * 10/2014

OTHER PUBLICATIONS

"EP-55 Preview." Victor Keyless Lock Inc. N.p., n.d. Web. Jan. 9, 2017. http://www.victorelock.com/Manuals. pp. 1-29.

*Primary Examiner* — Carlos Lugo
(74) *Attorney, Agent, or Firm* — Huffman Law Group, PC; Eric W. Cernyar

(57) ABSTRACT

An electronic deadbolt operator for a deadbolt lockset comprises an electronic actuator that rotates a powered driver and a follower that has a lost motion connection with the powered driver, enabling the follower to rotate with the powered driver when the follower is inside its range of travel, and enabling the powered driver to rotate freely of the follower after the follower is pushed to a travel limit. The follower is mounted to a connector driver, which drives the deadbolt, to toggle between two oppositely-disposed off-center positions relative to the connector driver. In one off-center position, only clockwise rotation of the powered driver is operative to rotate the follower. In the opposite position, only counterclockwise rotation of the powered driver is operative to rotate the follower. The interaction between the powered driver, the follower, and stops causes the follower to toggle to an opposite position after hitting a stop.

18 Claims, 15 Drawing Sheets

(51) Int. Cl.
*E05B 63/00* (2006.01)
*E05B 15/00* (2006.01)

(52) U.S. Cl.
CPC ..... *E05B 15/004* (2013.01); *E05B 15/0086* (2013.01); *E05B 2047/002* (2013.01); *E05B 2047/0084* (2013.01); *Y10T 292/1021* (2015.04)

(58) Field of Classification Search
USPC ..... 70/275, 277; 292/144
See application file for complete search history.

(56) References Cited

U.S. PATENT DOCUMENTS 3,910,613 A 10/1975 Nolin
4,418,552 A 12/1983 Nolin
4,516,798 A 5/1985 Bergen
4,606,203 A 8/1986 Esser
4,641,865 A * 2/1987 Pastva ..... E05B 63/0069 292/5
5,257,837 A 11/1993 Bishop
5,325,687 A 7/1994 Lin
5,496,082 A 3/1996 Zuckerman
5,611,581 A 3/1997 Ghostley
5,657,653 A 8/1997 Hensley et al.
5,713,612 A 2/1998 Kajuch
5,857,365 A 1/1999 Armstrong
6,012,310 A 1/2000 Hsiao
6,128,933 A 10/2000 Mirshafiee et al.
6,216,502 B1 4/2001 Cannella et al.
6,334,636 B1 * 1/2002 Huang ..... E05B 47/0012 292/138
6,406,072 B1 * 6/2002 Chen ..... E05B 47/0012 292/142
6,419,288 B1 7/2002 Wheatland
6,471,257 B1 10/2002 Lu et al.
6,517,127 B1 2/2003 Lu et al.
6,581,426 B2 6/2003 Bates et al.
6,584,818 B2 7/2003 Bates et al.
6,585,302 B2 * 7/2003 Lin ..... E05B 47/0012 292/142
6,591,643 B1 7/2003 Cannella et al.
6,598,909 B2 7/2003 Lu
6,612,141 B2 9/2003 Bates et al.
6,615,629 B2 * 9/2003 Bates ..... E05B 47/0607 70/107
6,918,276 B2 * 7/2005 Van Parys ..... E05B 47/0012 70/224
7,257,973 B2 8/2007 Romero et al.
7,363,784 B2 4/2008 Shvarts
7,516,633 B1 * 4/2009 Chang ..... E05B 13/101 292/251.5
7,770,423 B2 * 8/2010 Wu ..... E05B 47/0012 292/142
7,827,837 B2 * 11/2010 Huang ..... E05B 47/068 70/149
7,856,856 B2 12/2010 Shvartz
8,201,858 B1 6/2012 Moon et al.
8,292,336 B2 10/2012 Moon
8,419,086 B2 4/2013 Moon
8,424,935 B2 4/2013 Moon
8,490,445 B2 * 7/2013 Chiou ..... E05B 47/0012 70/224
8,621,900 B2 1/2014 Wu et al.
8,844,330 B2 9/2014 Moon et al.
9,033,375 B1 5/2015 Moon et al.
9,394,722 B2 7/2016 Moon et al.
9,528,300 B2 12/2016 Moon et al.
2001/0025517 A1 10/2001 Bates et al.
2001/0028172 A1 10/2001 Bates et al.
2012/0167646 A1 7/2012 Sharma et al.
2013/0192316 A1 * 8/2013 McKibben ..... E05B 47/0001 70/278.1
2014/0250956 A1 9/2014 Chong

* cited by examiner powered driver & follower with mated tailpiece driver powered driver & follower with mated tailpiece driver

ELECTRONIC DEADBOLT

RELATED APPLICATIONS

This application claims priority to my U.S. provisional patent application Ser. No. 62/250,374, filed Nov. 3, 2015, entitled "Electronic Deadbolt," which is herein incorporated by reference.

FIELD OF THE INVENTION

This present disclosure generally relates to electronic deadbolts, including sensor systems and methods of assembling and operating electronic deadbolts, and particularly to deadbolts that can be operated both electronically and mechanically, as by key or thumb turn.

SUMMARY

In one aspect of the invention, an electronic deadbolt operator for a deadbolt lockset comprises an electronic actuator that rotates a powered driver and a follower that has a lost motion connection with the powered driver, and a connector driver that drives a deadbolt between extended and retracted positions. This lost most connection is of a nature that allows the follower to rotate with the powered driver when the follower is inside its range of travel, while enabling the powered driver to rotate freely of the follower after the follower is pushed to a travel limit.

In another aspect, the follower is mounted to a connector driver, which drives the deadbolt, to toggle between two oppositely-disposed off-center positions relative to the connector driver. In one off-center position, only clockwise rotation of the powered driver is operative to rotate the follower. In the opposite position, only counterclockwise rotation of the powered driver is operative to rotate the follower. The interaction between the powered driver, the follower, and stops causes the follower to toggle to an opposite position after hitting a stop.

In a further aspect, stops are positioned to limit the angular travel of the follower between limits sufficient to extend and retract the deadbolt. When the follower reaches a stop and then toggles to an opposing off-center position in relation to the connector driver, the follower becomes positioned to become engaged by the powered driver for rotation in the opposite clockwise or counterclockwise direction.

Additional aspects of the invention accommodate situations in which the deadbolt lockset is operated manually after having been electronically operated to extend or retract the deadbolt. When this happens, as illustrated in FIG. 17, the connector driver and follower may be rotated a significant angular extent away from a coupling alignment. In some implementations, this may require that the electronic actuator perform a corrective rotation of the powered driver in a direction opposite of its last direction of travel in order to realign it with the follower, and then reverse the powered driver's rotation to drive the follower. But in a more preferred implementation, the powered driver can generally (e.g., when no jamming of the lock occurs) complete any lock operation (i.e., extending or retracting the deadbolt) from any position by rotating in a single direction.

More particularly, the follower and powered driver are co-configured so that when the two are significantly far from a coupling alignment and the deadbolt operator is commanded to re-perform its previous lock operation, the electronic actuator performs a corrective rotation of the powered driver along—and not opposite of—its previous direction of rotation until it is realigned with the follower, and continues the same rotation still further to drive the follower. Furthermore, in one implementation the powered driver is provided with two alternative projections by which the powered driver can become coupled to the follower. When performing the corrective rotation, a first of the projections toggles the follower to its oppositely-disposed off-center position, enabling the second of the projections to become coupled to the follower. By not using the same projection to drive the follower after a corrective rotation as is used to toggle the follower during the corrective rotation, this implementation reduces the length of time the electronic actuator has to be powered, saving energy and increasing battery life.

In another power-saving aspect, the electronic deadbolt operator includes a controller that, using information obtained from a sensor assembly, calculates an initial speed of the electronic actuator and from that determines a length of time to run the electronic actuator to complete a lock function.

In a far more detailed implementation, an electronic deadbolt assembly is provided that allows both mechanical rotation and intelligent electronic rotation. The electronic deadbolt assembly comprises a deadbolt lockset, a key cylinder on the ingress side (outside) of the door and a thumb turn on the egress side (inside) of the door for mechanically operating the deadbolt lockset, and an actuator assembly for at least electronically (and optionally also mechanically) operating the deadbolt lockset from an egress side of the door.

In one aspect, the actuator assembly comprises a housing, a controller, an actuator (such as an electric motor), an actuator-powered driver, a lost-motion follower, and a tailpiece driver. The actuator-powered driver and tailpiece driver are both configured to rotate.

In one implementation, the actuator is an electric motor, the housing comprises a gearbox, and the actuator-powered driver is the main gear of the gearbox. The gearbox output shaft has a press fit pinion gear with a bevel on the gear teeth corresponding and coacting with a main gear with beveled teeth having unlimited rotation. The main gear coacts with a follower (swivel disc) that has limited rotation. When properly positioned, the main gear rotates the follower, which is coupled to a tailpiece driver that is solidly coupled to a connector (e.g., a tailpiece hub) that rotates the tailpiece that operates the tubular dead bolt.

In another aspect, the actuator assembly includes a mechanical mechanism, discussed further below, that automatically decouples the actuator-powered driver from a tailpiece driver at the end of a lock/unlock operation. This enables a person to subsequently turn the key or thumb turn in an opposite direction, without continuing to engage the actuator.

In yet another aspect, the actuator assembly also includes a mechanism that toggles the follower—which is mounted on the tailpiece driver—between first and second settings. In the first setting, the follower is exclusively positioned to be actuator-driven in the clockwise direction. In the second settings, the follower is exclusively positioned to be actuator-driven in the counterclockwise direction. In both the first and second settings, the follower can be manually driven in either direction.

In one implementation, the follower is pivotally but not concentrically mounted to the tailpiece driver to swivel between a spring-biased leftward offset position and a spring-biased rightward offset position.

In another aspect, the actuator assembly comprises stops and limits that constrain the motion of the components. The follower is constrained to rotate between two fixed angular limits by a pin or detent that contacts either of two stops, located inside the housing, at a limit of rotation. The tailpiece driver is similarly constrained by the follower pin contacting either side of a swivel slot in the tailpiece driver.

In another aspect, the actuator-powered driver is freely able to continue rotating even when the follower reaches a limit of rotation.

In another aspect, the powered driver has two catches that project inwardly and radially from an outer rim. The outer rim of the follower is marked by two discontinuities (catches) that, when either is engaged by a corresponding catch of the powered driver, couples the follower to the powered driver for rotation with the powered driver. The relative sizes and coupling configuration of the powered driver and follower, along with the spring biasing of the follower, are such that the follower is not simultaneously coupled for rotation by the powered driver in both directions.

There is lost motion between the powered driver and follower allowing the tailpiece to be manually rotated without rotating the powered driver.

A sensor assembly and controller are provided to reduce the length the actuator-powered driver must travel, thereby increasing battery life. The sensor assembly detects whether the deadbolt was last manually manipulated or actuator-manipulated, and whether the deadbolt is extended, retracted, or somewhere in between. The controller estimates how long to run the actuator on the basis of this information. If the last manipulation of the deadbolt was manual and the deadbolt is only partially extended, the controller runs the actuator an additional length of time sufficient to realign the follower and the powered driver.

In one implementation, the sensor assembly comprises two switches on a front side of a divider and two switches on a backside of the divider. The switches are engaged when radial lobes extending from the actuator-powered driver or tailpiece driver cross over the switch levers or actuators. The back switches detect the angular position of the tailpiece driver, more specifically, whether the deadbolt is extended or retracted (or in between). The frontside switches detect the angular position of the actuator-powered driver, more specifically, whether it is oriented in a position near the start of a locking operation or at the end of a locking operation.

Both the powered driver and tailpiece driver have positive raised radial lobes that coact with simulated roller lever actuated micro switches. Two switches to sense the position of the powered driver and two switches to sense the position of the connector driver. The controller senses both the actuation and deactivation of all switches.

The electronic deadbolt assembly is operable to lock and unlock the cylindrical (tubular) dead bolt that can also be unlocked mechanically. Various improvements are included to lengthen the battery replacement cycle. The controller accounts for variations in motor RPM speed as battery voltage decreases with use.

The controller also accounts for the need to operate the deadbolt assembly different amounts as a function of the starting position, lock function (e.g., locked or unlocked) desired, and handedness of the door.

The controller is operable to lock or unlock the door from any position, without combining rotation and counter-rotation, and without first locking (or unlocking) the deadbolt in order to unlock (or lock) the deadbolt.

It should be understood that the invention does not require all of the features and aspects set forth in this summary or in the detailed description below. The invention may be characterized in many different ways along a continuum from highly specific to very general, and in ways that include equivalents and substitutes of the features and aspects describe above, and also in ways that include fewer than all of the features and aspects described above.

Other systems, devices, methods, features, and advantages of the disclosed assembly, including its sensors and algorithms, will be apparent or will become apparent to one with skill in the art upon examination of the following figures and detailed description. All such additional assemblies, systems, devices, methods, features, and advantages are intended to be included within the description and to be protected by the accompanying claims.

BRIEF DESCRIPTION OF THE DRAWINGS

The present disclosure may be better understood with reference to the following figures. Corresponding reference numerals designate corresponding parts throughout the figures. Drawings are not necessarily to scale.

DETAILED DESCRIPTION

Figure 1:
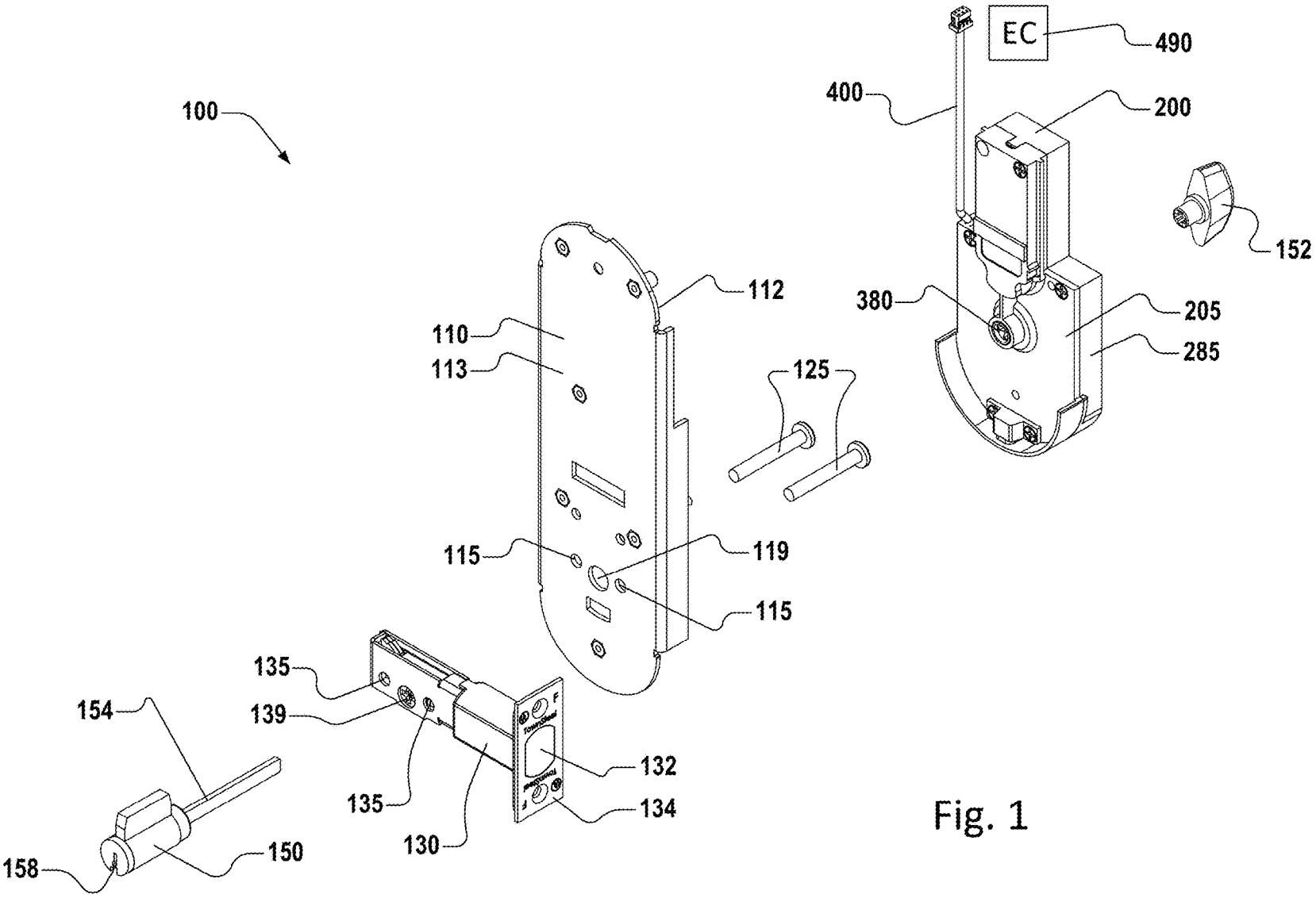
FIG. 1 is an exploded rearward view of a lockset assembly.

It will be appreciated that the drawings are provided for illustrative purposes and that the invention is not limited to the illustrated embodiment. For clarity and in order to emphasize certain features, not all of the drawings depict all of the features that might be included with the depicted embodiment. The invention also encompasses embodiments that combine features illustrated in multiple different drawings; embodiments that omit, modify, or replace some of the features depicted; and embodiments that include features not illustrated in the drawings. Therefore, it should be understood that there is no restrictive one-to-one correspondence between any given embodiment of the invention and any of the drawings.

Also, many modifications may be made to adapt or modify a depicted embodiment without departing from the objective, spirit and scope of the present invention. Therefore, it should be understood that, unless otherwise specified, this invention is not to be limited to the specific details shown and described herein, and all such modifications are intended to be within the scope of the claims made herein.

In describing preferred and alternate embodiments of the technology described herein, as illustrated in FIGS. 1-20, specific terminology is employed for the sake of clarity. The technology described herein, however, is not intended to be limited to the specific terminology so selected, and it is to be understood that each specific element includes all technical equivalents that operate in a similar manner to accomplish similar functions.

FIG. 1 is an exploded rearward view of one embodiment of an electronic deadbolt assembly 100, also referred to as an electronic lockset 100. The electronic deadbolt assembly 100 comprises a deadbolt lockset 130, a key cylinder 150 (housing not shown) with a keyhole 158 for mechanically operating the deadbolt 132 from the ingress side of a door (not shown), and an actuator assembly 200 for at least electronically (and optionally also mechanically via thumb turn 152) operating the deadbolt 130 from the egress side of the door. In one exemplary embodiment, the actuator assembly 200 comprises a gearbox, including a motor and gears. In alternative embodiments, the actuator assembly 200 uses a cam mechanism, a belt, a piston mechanism, hydraulic mechanism, a magnetic drive, or another suitable machine-based mechanism to lock or unlock a piston.

The actuator assembly 200 allows both manual rotation and intelligent machine-driven rotation of a cylinder tailpiece 154. Moreover, the actuator assembly 200 couples and decouples its motor-driven deadbolt locking/unlocking components (i.e., the motor and gears) from its manually-driven deadbolt locking/unlocking components (discussed further below). This enables manual rotation of the key cylinder 150 or thumb turn 152 without imparting motion to the motor-driven components of the actuator assembly. 200.

The tailpiece 154 passes through the latch cross slot 139 and a tailpiece aperture 119 in the door plate 110 and inserts into a corresponding cross slot 389 of a tailpiece hub 380 (FIG. 6) that is part of the electronic actuator assembly 200. Rotation of the tailpiece 154 moves the tubular deadbolt 132 through a strike plate 134.

Within the actuator assembly 200 is a motorized gear assembly and a sensor system 400 that communicate with an electronic controller 490. The electronic controller 490 may be housed outside of the actuator housing 205/285. External inputs from RFID chips, keypad entry, and other sources may initiate electronic operation by communicating with the electronic controller. Once woken up or prompted to perform a locking or unlocking operation, the electronic controller 490 identifies gear location and performs motorized unlocking and locking functions. Monitoring for successful completion of functions enables the electronic controller 490 to self-correct as necessary.

During installation, the rear face 113 of the door plate 110 is placed against the door. Door mounting bolts 125 are inserted through both the door mounting bolt holes 115 of the door plate 110 and the mounting bolt holes 135 of the deadbolt lockset 130. The rear housing 205 of the actuator assembly 200 is mated with the front face 112 of the door plate 110. A decorative closure (not shown) is placed over the front housing 285 of the actuator assembly 200 and likewise mated to the door plate 110. The particular installation shown is for a left handed door, but the present invention serves any hand.

Figure 2:
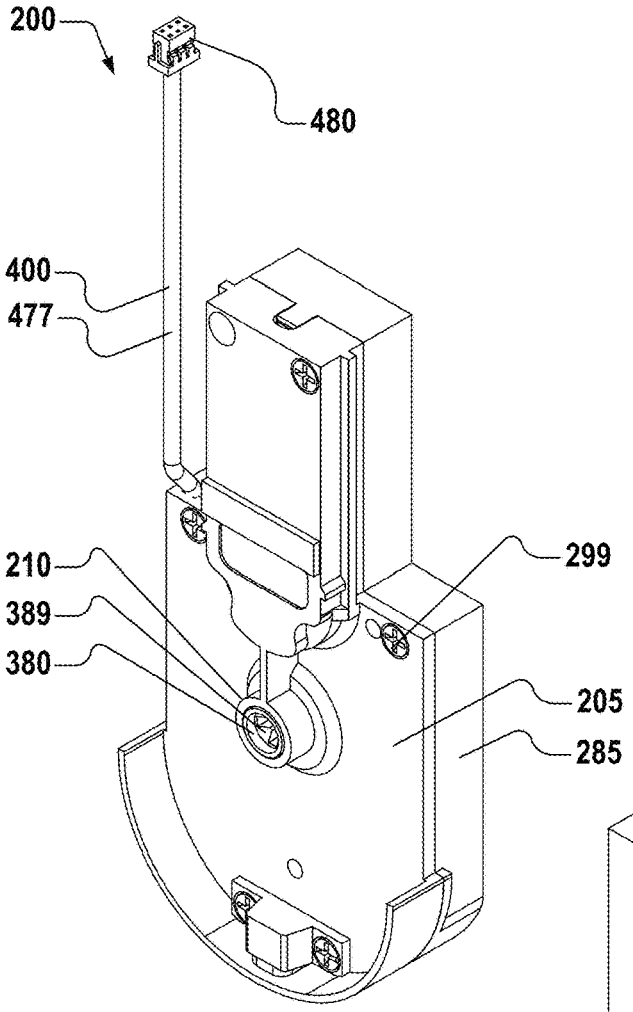
FIG. 2 is a rear perspective view of an assembled actuator.
Figure 3:
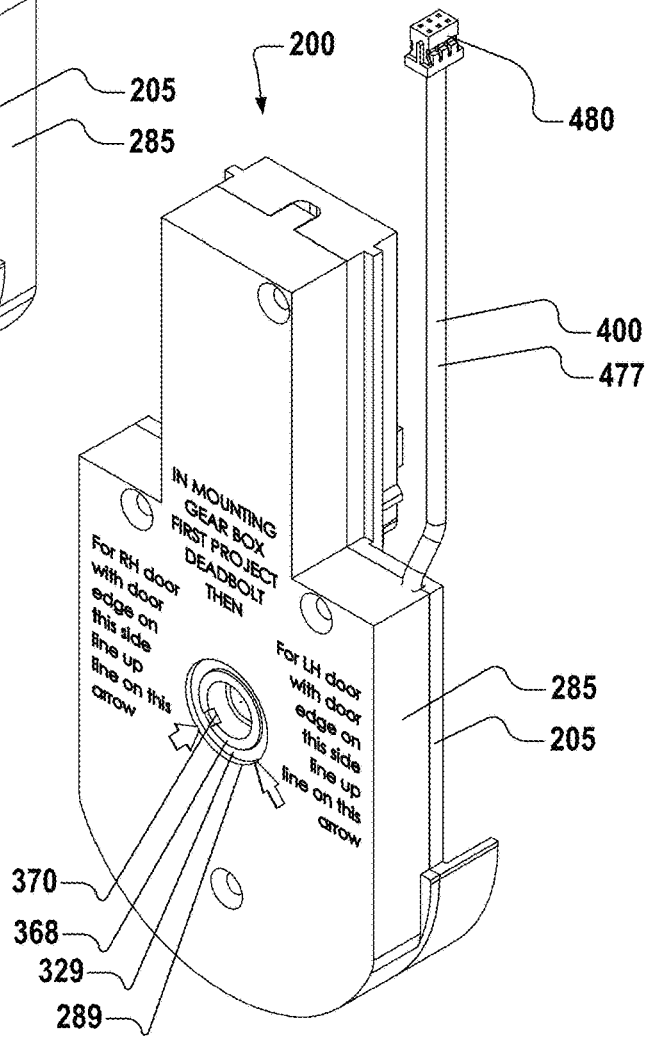
FIG. 3 is a front perspective view of the assembled actuator of FIG. 2.
Figure 4:
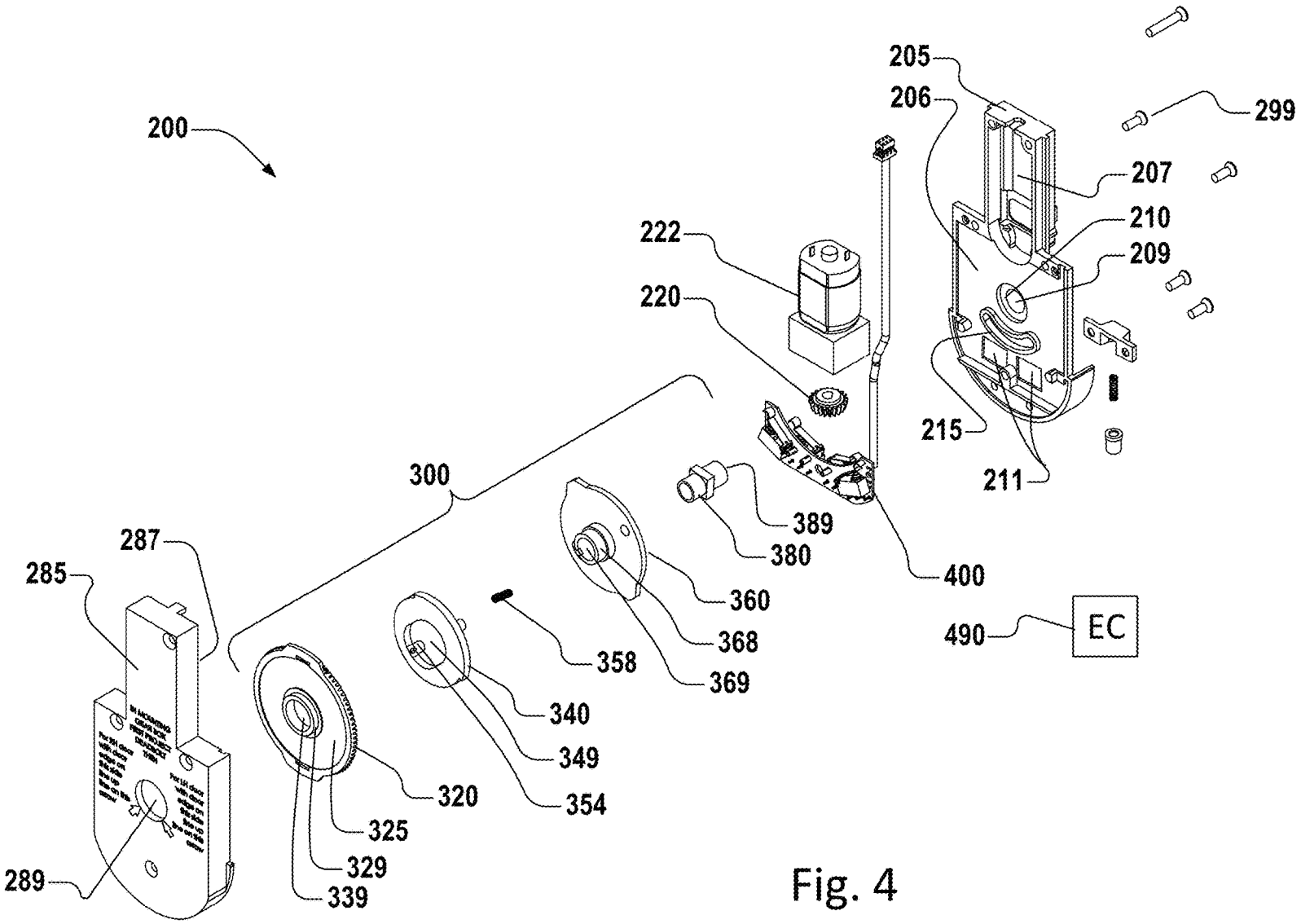
FIG. 4 is an exploded frontside view of the actuator assembly.

FIGS. 2 and 3 are rear and front perspective views, respectively, of an assembled actuator assembly 200, which includes a rear housing 205 attached to a front housing 285. And FIG. 4 is an exploded frontside view of the actuator assembly 200, including an actuator (such as a motor) 222, a manually and mechanically operable tailpiece driving assembly 300, a sensor assembly or system 400, and a controller 490. The tailpiece driving assembly 300 comprises a powered driver 320 (which, in accordance with the implementation illustrated in the drawings, can also be referred to as a tailpiece driving gear), a connector driver 360 (also referred to as a tailpiece driving disc), a follower 340 (also referred to as a swivel disc), and a tailpiece hub 380.

Focusing initially on FIGS. 2 and 3, a rear housing 205 of the actuator assembly 200 is attached to a front housing 285 via screws 299, snap closure (not shown), or other means of connecting the housings. The front housing 285 has an interior chamber section 287 for an actuator such as a motor. Likewise, the rear housing 205 has an interior motor chamber section 207. Hence the actuator assembly 200 resembles a tower when assembled.

The rear housing 205 also comprises a rear housing hub 210 into which the tailpiece hub 380 of the tailpiece driving assembly 300 projects. The tailpiece hub 380 has an aperture that is a cross slot 389 suitable for receiving a tailpiece 154 of the electronic lockset 100. Although a cross-shaped slot is typically employed, the slot of the tailpiece hub 380 is not limited to a cross shape. The rear housing hub 210, as well as the other housing and component parts, is formed of a material, along with any reinforcing ribs or structures, sufficiently durable for use in a lockset 100, particularly for repeated use and resistance to intrusion. Such materials may include, but are not limited to, steel, carbon, polymers, and composite materials.

Opposite the rear housing hub 210 is an aperture 289 in the front housing 285. The hub 329 on the tailpiece driving gear 320 is positioned against the aperture 289, with the frontside mounting hub 368 of the tailpiece driving disc 360 (FIG. 4) nested into the tailpiece driving gear hub 329. An installer sets the alignment mark 370 (FIG. 9) of the frontside mounting gear 368 for a right handed or left handed door as appropriate prior to inserting the tailpiece 154 (not shown here).

In one implementation, wiring 477 from a sensor assembly 400 exits the actuator housing 205/285 and terminates in a plug 480 designed to interface with an electronic controller 490. On the basis, at least in part, of the signals it receives from the sensor assembly 400, the electronic controller 490 intelligently actuates the actuator/motor 222 to lock or unlock the tubular dead bolt 132. However, the sensor wiring 477 and electronic controller 490 are not required to reside outside of the actuator housing 205/285.

Turning now to FIG. 4, the tailpiece driving gear 320 rotates the swivel disc 340, which is coupled to the tailpiece driving disc 360 that is solidly coupled to the tailpiece hub 380, which rotates the tailpiece 154 that operates the tubular deadbolt lockset 130. The tailpiece driver assembly 300 is designed to enable the deadbolt assembly 100 to either lock or unlock, and to do so from any starting position. Since the motor 222 and the tailpiece 154 are not directly connected, a means is provided that allows both mechanical rotation and intelligent electronic rotation through specific motor and sensor routines.

As noted above, the actuator is in one implementation a motor 222, and the actuator or gearbox assembly 200 is housed in the interior motor chamber 207/287. Residing on the motor's 222 output shaft is a press fit pinion gear 220 that has a bevel on the gear teeth 223 corresponding to and coacting with a tailpiece driving gear 320, which is the main gear, with beveled teeth 323 and having unlimited rotation. The tailpiece driving gear 320 is a relatively thin part; as such, it may also be called a pancake gear. Many elements of the actuator assembly 200, and particularly the tailpiece driving assembly 300, are designed to take up minimal space in order to function on a door and/or allow an attractive finish. While these parts are not limited to a relatively thin design, and a modified design may use more parts or a larger space, one of skill in the art will recognize that the present invention gains substantial functionality via this streamlined design.

Figure 14:
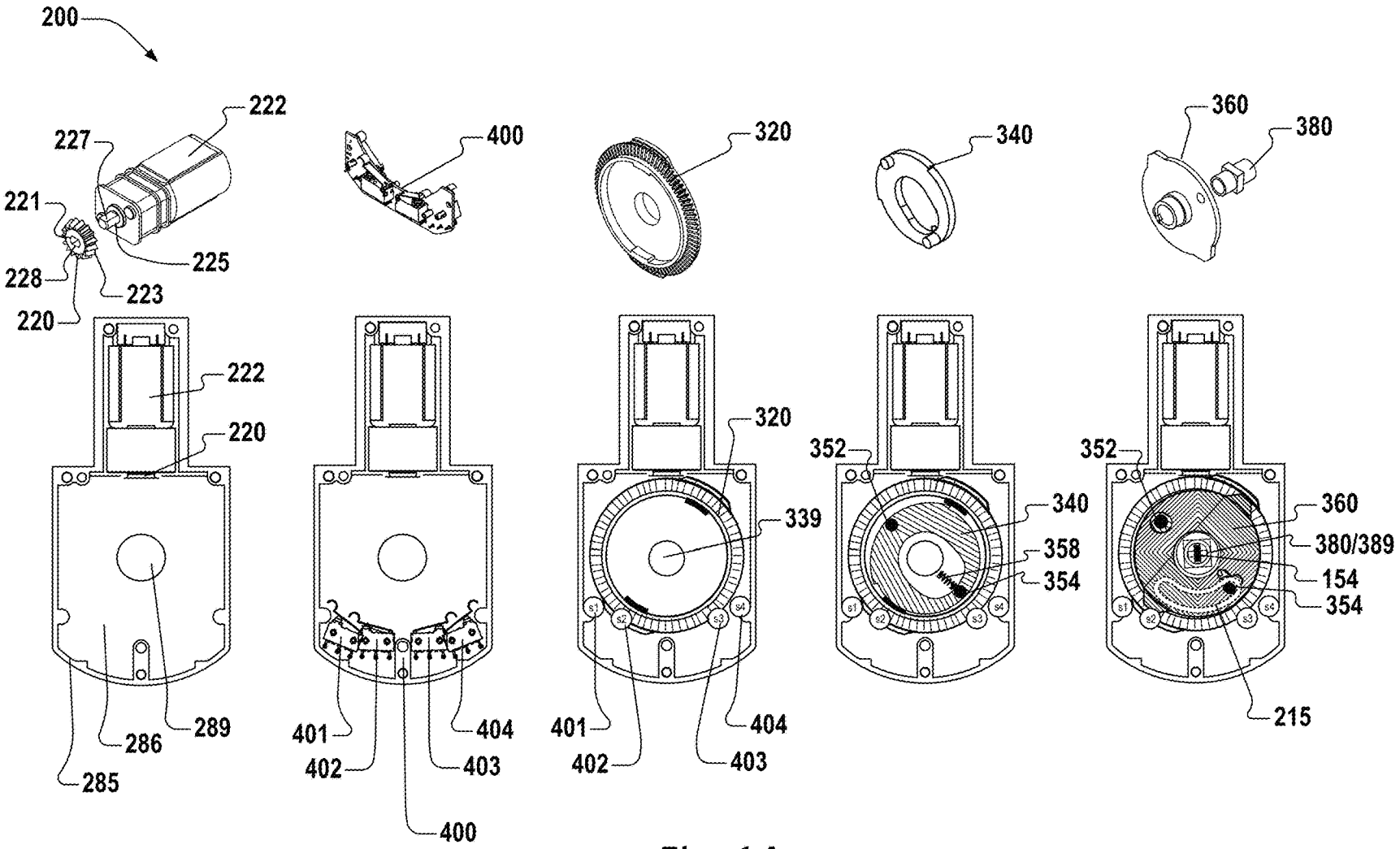
FIG. 14 is a rearward view of the incremental assembly of actuator components.

The motor shaft 225 and bevel gear 220 themselves, seen more clearly in FIG. 14, also provide improved performance. Two motor shaft flats 227 ground on opposing sides of the motor shaft 225 engage matching bevel gear flats 228 on the motor output shaft aperture 221 in the bevel gear 220 to generate increased torque. The present invention may have one motor shaft flat 227 such that the aperture 221 is D-shaped, or the motor shaft 225 may have more than two motor shaft flats 227, the one or more motor shaft flats in any functional orientation.

Focusing now on the remaining components of the tailpiece driving assembly 300, the tailpiece hub 380, when assembled, partially nests in the frontside mounting hub 368 of the tailpiece driving disc 360. In turn, the frontside mounting hub 368 passes through the aperture 349 in the swivel disc 340 and into the frontside hub 329 on the tailpiece driving gear 320, which rests in the interior of the front housing 285. As illustrated in FIGS. 16-20, a bias spring 358 links the tailpiece driving disc 360 to the swivel disc 340 such that the swivel disc 340 acts as a lost-motion follower. The rearward end of the tailpiece hub 380 rests within the rear housing hub 210 on the interior face 206 of the rear housing 205. Thus, when the housing 285/205 is closed, the apertures 289/339/349/369/389/209 of the various pieces of the actuator assembly 200 are aligned.

A sensor assembly 400 that interacts with the tailpiece driving assembly 300 is installed within the housing 285/205 and, in one implementation, under the tailpiece driving assembly 300. The two rear sensors 402/403 match the recesses 211 on the interior face 206 of the rear housing 205. The sensor assembly 400 will be discussed in greater detail later in this application. An electronic controller 490 is in communication with the sensor assembly 400, motor 222, and inputs that activate the actuator assembly 200.

As the housing 285/205 is closed together, the pivot stop 354 or detent 354 on the rear face 341 of the swivel disc 340 becomes inserted into an arcuate slot 215 on the interior face 206 of the rear housing 205. Given its shape, and for ease of comprehension, the arcuate slot 215 is herein nicknamed the "smile slot."

Figure 5:
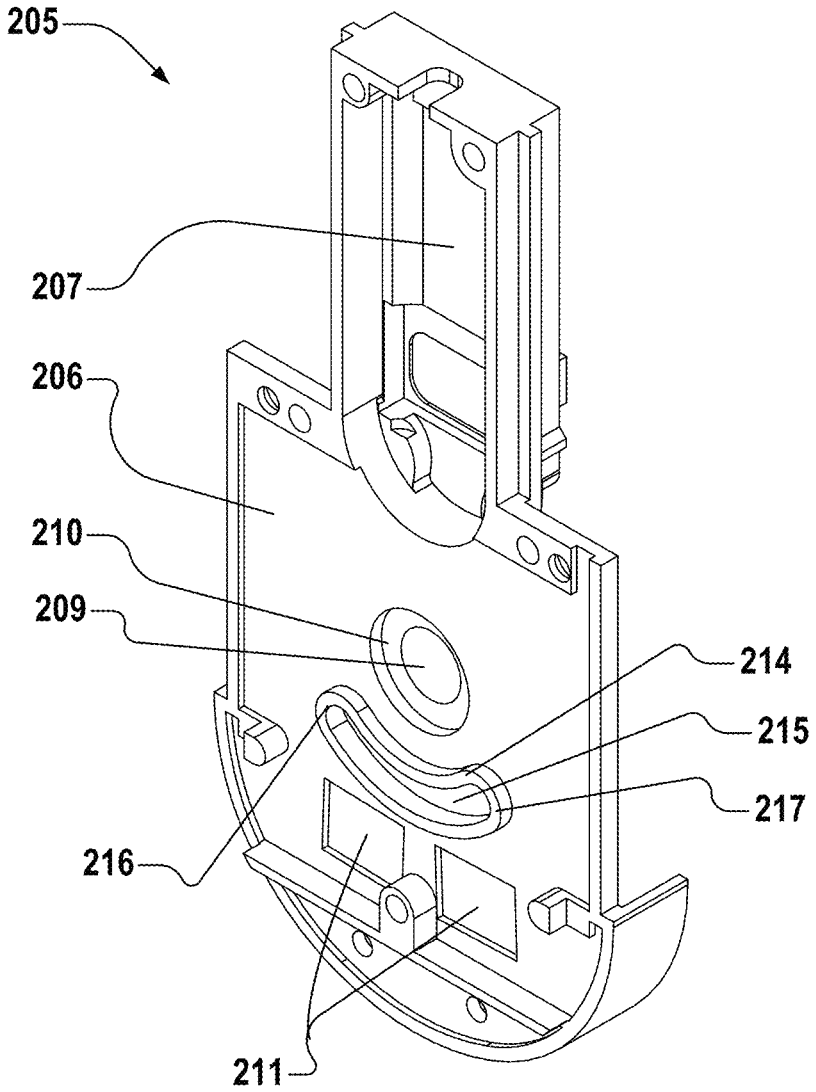
FIG. 5 is a front perspective view of the rear actuator housing.

FIG. 5 is an enlarged front perspective view of the rear actuator assembly housing 205 that shows the rear housing interior 206. In one aspect, the actuator assembly comprises stops and limits that constrain the motion of the components. Beneath the rear housing hub 210 and its aperture 209 sits the smile slot 215. The walls 214 of the smile slot 215 are deep enough to provide substantial contact area for the pivot stop 354 of the swivel disc 340. As the swivel disc 340 rotates clockwise, the slot wall 214 acts as a left stop 216 or clockwise stop 216. As the swivel disc 340 rotates counterclockwise, the slot wall 214 acts as a right stop 217 or a counterclockwise stop 217. Thus the swivel disc 340 is constrained to rotate between two fixed angular limits by the pivot stop or detent 354 that contacts either of two stops 216/217 at a limit of rotation. Recesses 211 for sensor assembly 400 mounting are also shown, as is the rear motor chamber 207.

Figure 6:
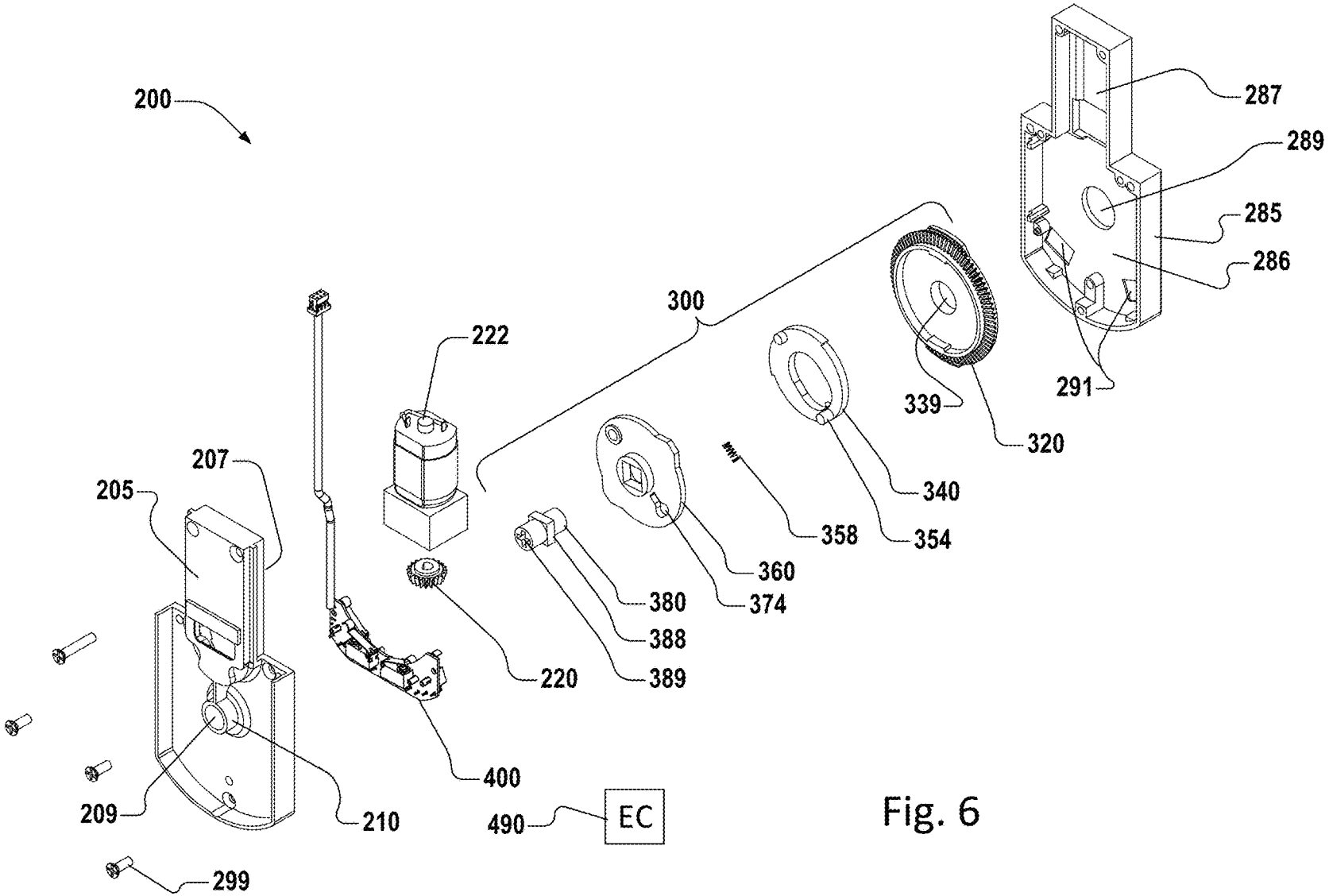
FIG. 6 is an exploded rearward view of the actuator assembly of FIG. 4.
Figures 10, 11:
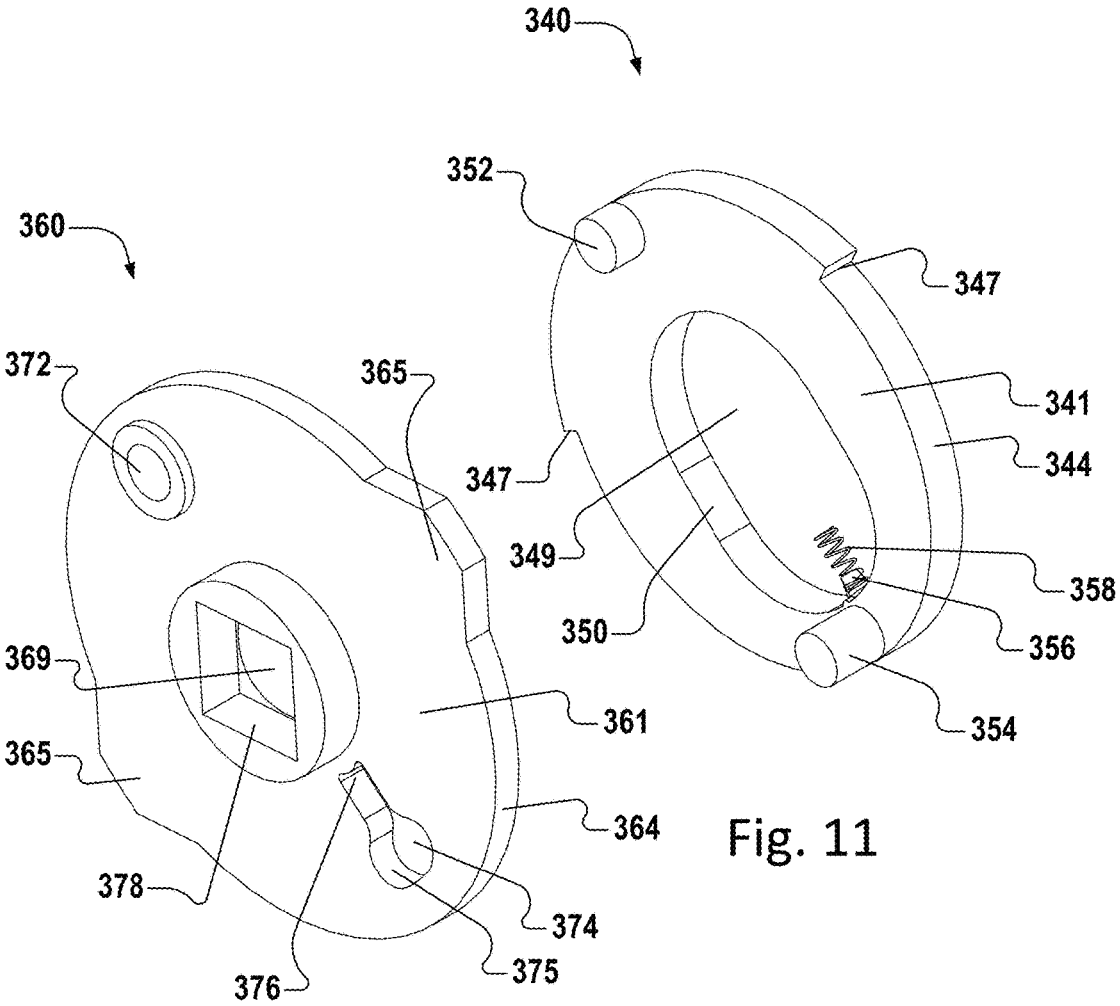
FIG. 10 is a rear perspective view of the tailpiece driving disc of FIG. 9.
FIG. 11 is a rear perspective view of the swivel disc of FIG. 8.

As shown in FIGS. 6, 10 and 11, the tailpiece driving disc 360 is similarly constrained between angular limits of rotation by the follower pin 354 contacting either side of a swivel hole 374 in the tailpiece driving disc 360. When the swivel disc 340 is mounted to the tailpiece driving disc 360, the follower pin 354 toggles between the two sides of the swivel hole 374, owing to the biasing force of the spring 358. As will become clear in connection with FIGS. 15-20, the tailpiece driving disc 360 is able to rotate between a slightly wider angular range than the swivel disc itself, because the swivel hole 374 is wider than the pivot stop 354 itself.

Figure 7:
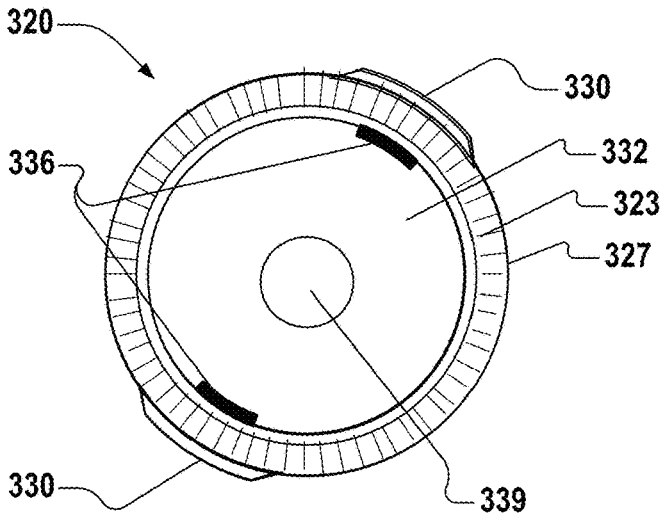
FIG. 7 is a rear view of a tailpiece driving gear.

FIG. 7 is a rear view of a tailpiece driving gear 320 (pancake gear 320), which is the main gear of the actuator assembly 200, with radial gear teeth 323 that have a bevel to integrate with the motor-driven bevel gear 220. The rear side of the tailpiece driving gear 320 provides a seat for the swivel disc 340 large enough for it to swivel about the follower pin 354 between opposing leftward and rightward offset positions. Projecting inwardly from the rear recess or seat 332 are inwardly extending radial lobes 336 that act as gear catches 336, one for clockwise rotation and the other for counterclockwise rotation. Depending on the direction of rotation, the appropriate gear catch 336 engages and disengages with a corresponding shoulder-like disc catch 347 of the swivel disc 340, constraining it to rotate with the tailpiece driving gear 320 until its pivot stop 354 has reached the corresponding limit 217, 218 of the smile slot 216. Once it reaches this limit, the blockage of the follower pin 354, coupled with the tailpiece driving gear 320's continued force against the disc catch 347, creates a moment that overcomes the hysteresis of the spring 358, causing the swivel disc 340 to pivot about pivot pin 352 and swivel to the opposite offset position. This, in turn, causes the follower pin 340 to toggle to the opposite side of the swivel hole 374 (compare FIGS. 17(*j*) and 17(*l*)). Importantly, the movement of the swivel disc 340 to the opposite offset position with respect to the tailpiece driving disc 360 causes its disc catch 347 to escape the gear catch 336 that had just been driving it. This frees the tailpiece driving disc and swivel disc 336 to rotate (under manual operation) in the opposite direction, reversing the just-completed motor-driven (un)locking action without interference from the driving gear 320.

Projecting outwardly from the side 327 of the tailpiece driving gear 320 are two positive, radial lobes that are sensor triggers 330. Because these sensor triggers 330 are used to detect positions of tailpiece driving gear 320, they may alternatively be referred to as actuator-position-marking sensor triggers 330 or fingers. In the exemplary embodiment illustrated in the drawings, the sensors that are triggered comprise switches, but the invention is not limited to switches, as there are a variety of alternative forms of sensors that would also be suitable, including but not limited to angle sensors, light sensors, magnetic sensors, and the like. In the illustrated embodiment, the sensor triggers 330 are diametrically opposed to each other and of the same shape and size. The sensor triggers 330 are extensions of the front face 325 (FIG. 4) or the rear recess 332 of the tailpiece driving gear 320 with a depth equal to the depth of that wall. The tailpiece driving gear 320 has a center aperture 339 that aligns with its hub 329 on the front. Two gear catches 336 are inward-extending radial lobes that reside in the rear recess 332 where its perimeter meets the radial gear teeth 323 to form an outer rim. The gear catches 336 are also diametrically opposed to and of the same shape and size as each other, with each gear catch radially aligned with one of the two sensor triggers 330. It will be noted that the gear catches 336 and sensor triggers 330 are sized and shaped to permit rotation in a tight space and relative to other components. One of skill in the art will understand that other sizes and shapes may be employed for the lobes to produce a comparable actuator assembly 200 provided the functionality between components is maintained.

FIGS. 8-11 illustrate the relationship between the swivel disc 340 and the tailpiece driving disc 360. As touched upon briefly above, the swivel disc 340 is sized to nest within the rear recess 332 of the tailpiece driving gear 320, with the front face 342 of the swivel disc 340 against the wall of the rear recess 332. The outer rim or edge 344 of the swivel disc 340 is marked by two discontinuities called disc catches 347 that, when either is engaged by a corresponding gear catch 336 of the tailpiece driving gear 320, couples the swivel disc 340 to the powered tailpiece driving gear 320 for rotation therewith. The relative sizes and coupling configuration of the tailpiece driving gear 320 and the swivel disc 340, along with the spring biasing of the swivel disc 340, are such that the swivel disc 340 is not simultaneously coupled for rotation by the tailpiece driving gear in both directions.

Figure 8:
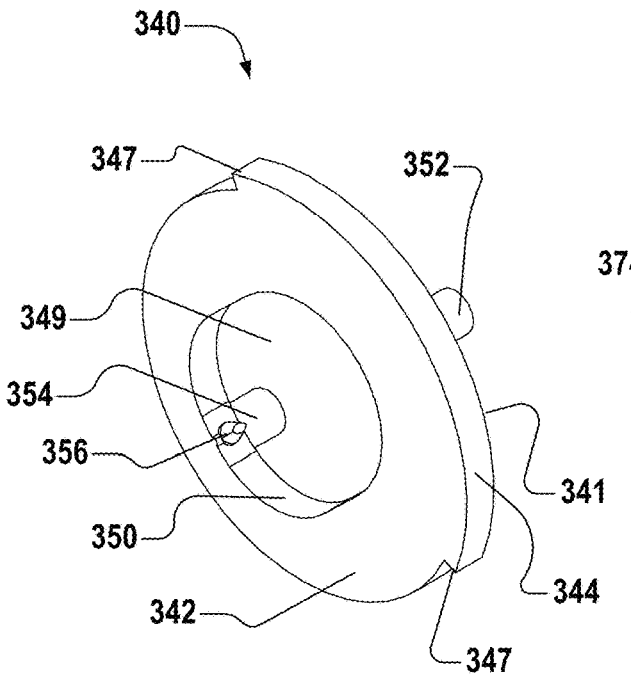
FIG. 8 is a front perspective view of a swivel disc.
Figure 9:
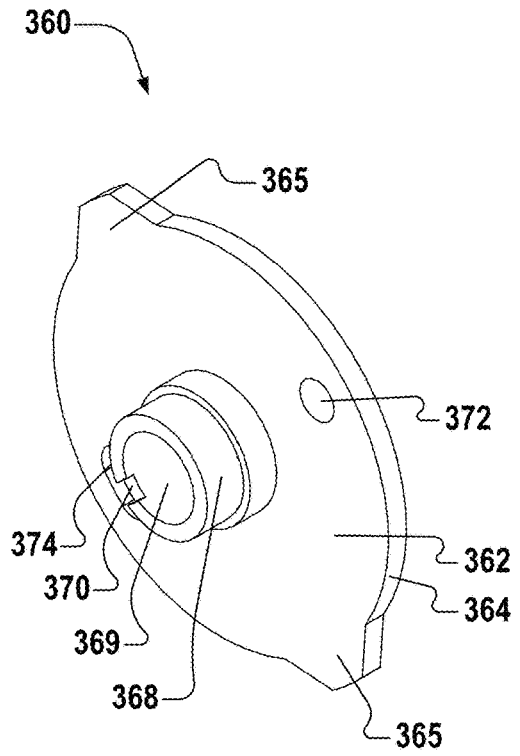
FIG. 9 is a front perspective view of a tailpiece driving disc.

FIG. 8 is a front perspective view of a swivel disc 340 that mates with the tailpiece driving disc 360 of FIG. 9, also a front perspective view. The swivel disc 340 has a front face 342, a rear face 341, an outer edge 344, and an inner edge 350 formed by an oblong center aperture 349. As stated, the outer edge 344 has discontinuities that form two narrow shoulder-like disc catches 347, the catches 347 being opposed to each other, but both positioned toward the pivot pin 352 side of the swivel disc 340 and equally spaced from the pivot pin 352, which is on the rear face 341. A pivot stop or detent 354, also called a follower pin 354, is likewise on the rear face 341 on the other side of the aperture 349, with the disc catches 347 also equally spaced from the detent 354. A spring nub 356 is located on the inner edge 350 in line with the detent 354 and pivot pin 352. The shape of the aperture 349 is of less importance than its ability to allow the swivel disc 340 to swivel across the front face 362 of the tailpiece driving disc 360 and still provide room for the frontside mounting hub 368 and accommodate a bias spring 358.

The tailpiece driving disc 360 has a front face 362 with a centrally located frontside mounting hub 368 with aperture 369 designed to accommodate a tailpiece hub 380 (not shown). An alignment mark 370 on the front edge of the mounting hub 368 is used by installers to calibrate for the handedness of the door. A pivot bore 372 is designed to accept the pivot pin 352 of the swivel disc 340. A swivel hole 374 accepts the detent or pivot stop 354 of the swivel disc 340. The edge 363 of the tailpiece driving disc 360 has two opposing, outwardly extending lobes that are sensor triggers 365, more particularly, lock-position-indicating sensor triggers 365. The sensor triggers 365 have a generally trapezoidal shape and an axis through the sensor triggers 365 is perpendicular to an axis through the pivot bore 372 and swivel hole 374. One of skill in the art will understand that other sizes and shapes may be employed for the earlike lobes to produce a comparable actuator assembly 200 provided the functionality between components is maintained.

FIG. 10 is a rear perspective view of the tailpiece driving disc 360 (of FIG. 9) that mates with the swivel disk 340 of FIG. 11, also a rear perspective view (of FIG. 8). The rear face 361 of the tailpiece driving disc 360 has a centrally located square receiver 378 and aperture 369 for receiving and holding the tailpiece hub 380 (FIG. 6). To one side of the square receiver 378, and perpendicular to an axis through the sensor triggers 365, is the pivot bore 372 that, with its raised perimeter on the rear face 361, may be called a pivot bearing 372. To the other side of the square receiver 378 is the swivel hole 374 or slot having an inner surface 375 and a spring nub or catch 376. In practice, the pivot bore 372 is placed over the pivot pin 352, and the swivel hole 374 is placed over the pivot stop or detent 354. The bias spring is placed on and between the spring nub on the swivel disc 340 and the spring nub or catch 376 on the tailpiece driving disc. In this way, in one implementation, the swivel disc 340 is pivotally but not concentrically mounted to the tailpiece driving disc 360 to swivel between a spring-biased left-favoring position and a spring-biased right-favoring position.

Figure 12:
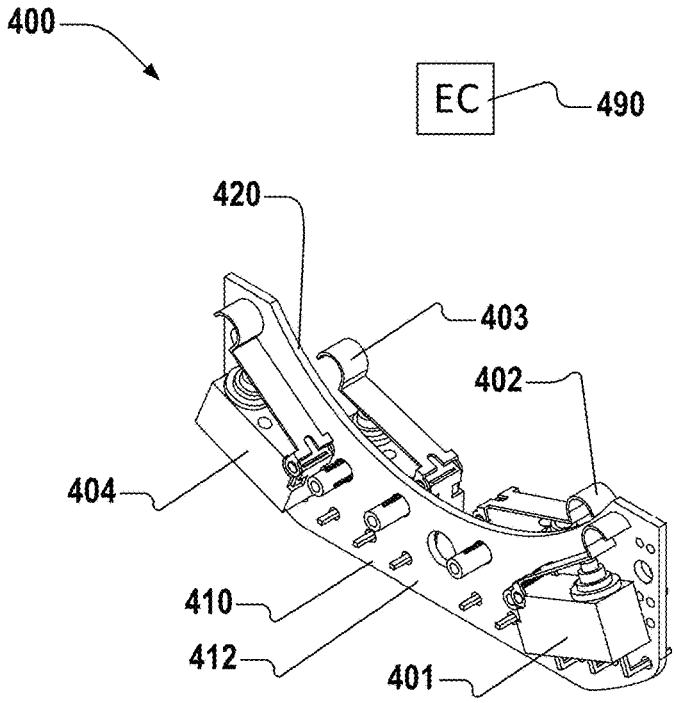
FIG. 12 is a front perspective view of a sensor assembly.
Figure 13:
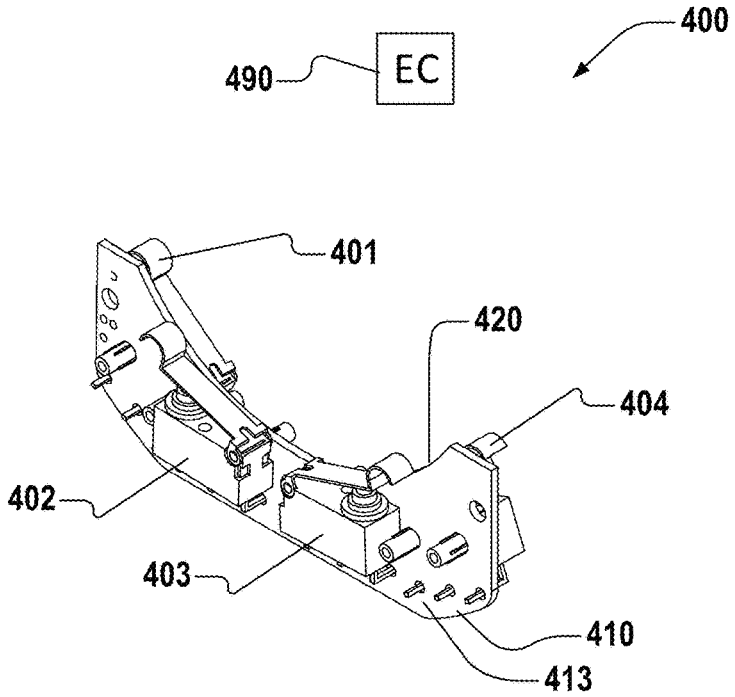
FIG. 13 is a rear perspective view of the sensor assembly of FIG. 12.

FIG. 12 is the front and FIG. 13 the rear perspective view of a sensor (switch) assembly 400, not including the wiring 477 or plug 480 illustrated in FIGS. 2-3. In one implementation, the sensor assembly 400 comprises two switches 401 and 404 (also referred to as S1 and S4, respectively) on a front side 412 of a divider or sensor base 410 and two switches 402 and 403 (also referred to as S2 and S3, respectively) on a back side 413 of the sensor base 410. Various supporting structures, spacers, and apertures to aid assembly and protection of the switches S1-S4 and wiring (not shown) are included on the base 410. The switches S1-S4 provide input to the electronic controller 490 via wiring 477 and connectors and plugs 480. Alternatively, the sensor assembly 400 may be wireless.

The sensor base 410 has an arcuate top edge 420 that corresponds with the radial tailpiece driving assembly 300. Both the tailpiece driving gear 320 and the tailpiece driving disc 360 have positive, raised radial lobes projecting from their sides to coact with simulated roller lever actuated micro switches S1-S4 as the radial lobes roll over the switch levers. The sensor assembly 400 is not limited to use of lever actuated switches S1-S4, but may incorporate other mechanisms including, but not limited to, other types of contact switches, non-contact triggers such as electromagnetics, and angle sensors that may replace two sensors with one. One of skill in the art will understand that sensor logic can easily be adapted to many different types of sensor type.

The controller 490 senses both the actuation and deactivation of all switches S1-S4. Back side 413 switches S2 and S3 detect the angular position of the tailpiece driving disc 360 via the sensor triggers 365 and tell the controller 490 whether the deadbolt 132 is locked or unlocked, or even in between (partially extended or partially retracted) if neither switch S2 nor S3 is depressed. Front side 412 switches S1 and S4 detect the angular position of the tailpiece driving gear 320 via the sensor triggers 330 and, more specifically, detect whether the tailpiece driving gear 320 is oriented in a position near the start of a locking operation or near the end of a locking operation.

Thus, the sensor assembly 400 is operative to sense the position of both the tailpiece driving gear 320 and the swivel disc 340. It senses whether the tailpiece driving disc 360 is in a position (switch S2) that corresponds with the deadbolt 132 being in an extended position or in a position (switch S3) that corresponds with the deadbolt 132 being in a retracted position. It also senses whether the tailpiece driving gear 320 is in a first angular position (switch S1) or a second angular orientation (switch S4). The controller 490 memory records a last power-driven position of the deadbolt 132 independently of the current position of the deadbolt 132.

In contrast, certain prior art uses only a single pair of switches to determine the position of the dead bolt, but has no way to know how long to power the motor because it does not know the position of all parts when it starts. One popular line of prior art products uses a clutch to keep from getting fatally stuck, but the clutch prohibits high torque and efficient operation. Other prior art uses excessive back and forth movement, with waits between movements, to execute a wasteful routine due to lack of awareness of gear and deadbolt positions. Still other prior art sometimes uses a limit switch to determine end of travel and has fixed maximum and minimum run times that do not fully take into consideration the variations in RPMs over different voltage and temperature conditions. Motors and gearboxes run slower when cold due to changes in friction. Using fixed time for running a motor is not efficient because the system perpetually over travels to get to the new state (locked or unlocked), as it must travel enough at low battery conditions when the motor is running slower, and thusly over travels with higher battery voltages.

In the embodiment of FIGS. 12-13, the sensor assembly 400 comprises four switches S1, S2, S3 and S4. Moreover, by comparing the position of the deadbolt 132 with the position of the tailpiece driving gear 320, the controller 490 detects, for example, whether the deadbolt 132 was manually retracted after being electronically locked via the actuator 222. Likewise, the controller 490 detects whether the deadbolt 132 was manually extended (i.e., the door was manually locked) after being electronically unlocked.

With this information, the controller 490 estimates how long to run the actuator 222. For example, if the last manipulation of the deadbolt 132 was manual and the deadbolt 132 is only partially extended, the controller 490 runs the motor 222 an additional length of time (see FIG. 18) sufficient to realign the tailpiece driving gear 320 with the swivel disc 340. Once the motor 222 is powered, the controller 490 measures the time it takes for a first switch S2 or S3 to deactivate and sets an expected maximum time for the determined rotation time when a second switch S3 or S2 should be activated (in proportion to the time it took to rotate far enough to deactivate rotation). This is a variable consistent with the variability of both the voltage present in the battery cells as they age (voltage decays as much as 50%) and the ambient temperature conditions.

By quickly sensing a stuck deadbolt 132, the controller 490 will quickly reverse and retry as a function of the software decision-making allowed by the complexity of the multiple function switches S1-S4 that convey both deactivation time (when a sensor trigger 330 or switch finger 365 departs from the switch arm) and activation time (when the sensor trigger 330 or switch finger 365 sufficiently contacts the switch arm). The controller 490 uses this procedure for both the locking direction and the unlocking direction, and does so much more quickly than the prior art. Advantageously, this process minimizes the stress of a motor 222 powered in the stalled condition, as well as mitigates the cause.

FIG. 14 is a rearward view of the incremental assembly of actuator assembly components. First, a bevel gear 220 having gear teeth 223 and a shaft aperture 221 is placed onto the shaft of a motor 222, which is then seated in the interior 286 of the front housing 285. The front housing aperture 289 is visible. Second, the sensor assembly 400 with switches 51, S2, S3, and S4 is installed on the base of the front housing 285. Third, the tailpiece driving gear 320 is placed such that its gear teeth 323 coact with the bevel gear 220, so its frontside hub 329 (not shown) and aperture 339 align with the aperture 289 of the front housing 285, and so that it aligns over switches 51 and S4. Fourth, the swivel disc or follower 340 is nested within the tailpiece driving gear 320 with the pivot pin 352 and detent 354 facing the viewer. The bias spring 358 is visible. Fifth, the tailpiece driving disc 360 is placed on the pivot pin 152 and detent 354 of the swivel disc 340, with the bias spring 158 connected to both. The tailpiece driving disc 360 lines up with switches S2 and S3. Then the tailpiece hub 380 is inserted into the tailpiece driving disc 360. The tailpiece hub 380 comprises a cross slot 389, and for illustrative purposes the tailpiece 154 is shown in that cross slot 389 as would be the case after installation on a door. Finally, the smile slot 215 is illustrated with dashed lines to show its orientation after the rear housing (not shown) is attached. The detent or pivot stop 354 is situated in the smile slot 215.

FIGS. 15-20 illustrate the operation and interaction of the components of the tailpiece driving assembly 300 and sensor assembly 400 according to one embodiment of the invention. Parts are labeled with thorough detail in FIG. 15 for reference in the succeeding figures which, for clarity, include only labels that are most relevant to the narrative.

Figure 15:
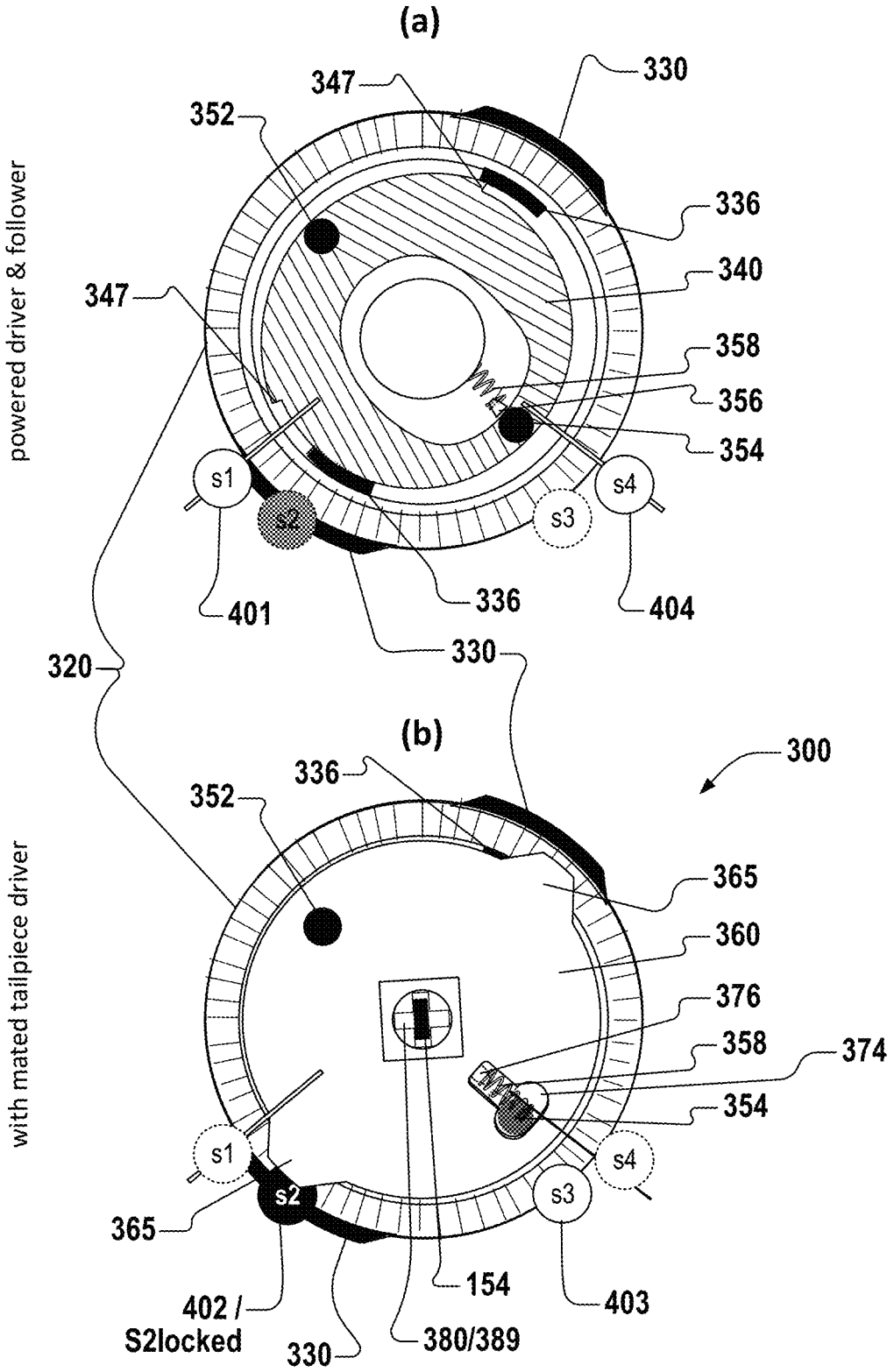
FIG. 15 is a rearward view of the relationship between the tailpiece driving gear, swivel disk, tailpiece driver disc, and sensors when the deadbolt that is configured for a right-hand (RH) door is locked.

FIG. 15 shows a rearward view of the relationship of tailpiece driving gear 320, the tailpiece driving disc 360, and the swivel disc 340 after the motor 222 of the actuator assembly 200 drives a deadbolt 132 to locked position for a right-hand door configuration. FIGS. 15(*a*) and 15(*b*) are two different layered views of the tailpiece driving assembly 300 in the same position. FIG. 15(*a*) illustrates the interaction between the tailpiece driving gear 320 and the swivel disc 340. It also illustrates how the tailpiece driving gear 320 can interact with sensors S1 and S4. FIG. 15(*b*) illustrates the interaction between the swivel disc 340 and the tailpiece driving disc 360, the latter of which is almost entirely concealed, revealing only the of pivot pin 352, detent 354, and spring nub 356 FIG. 15(*b*) also illustrates how the tailpiece driving disc 360 can interact with the sensors S2 and S3.

Both (a) and (b) show the tailpiece driving gear 320 and actuator-position-marking sensor triggers 330, bias spring 358, and relative locations of sensors S1, S2, S3, and S4. FIG. 15(*a*) shows the swivel disc 340 nested within the tailpiece driving gear 320, as well as the gear catches 336 and disc catches 347 of those two parts. FIG. 15(*b*) then shows the tailpiece driving disc 360, with its lock-position-indicating sensor triggers 365, mated over the swivel disc 340 via the pivot pin 352 and the pivot stop 354. The bias spring 358 joins the spring nub 356 of the swivel disc 340 to the spring nub 376 of the tailpiece driving disc 360. The swivel disc 340 and its pivot stop or detent 354 is at its maximum counter-clockwise position (stopped by the smile slot 215).

FIG. 15(*b*) illustrates one of the tailpiece driving disc 360's sensor triggers 365 interacting with sensor S2. For example, in the implementation in which S2 is a switch, it would be closed if the position of switch S2 is normally open, or open if the position of switch S2 is normally closed. For purposes of clarity, switches S1-54 in the embodiment of FIGS. 15-20 are henceforth described as being closed when they are triggered. It will be understood, of course, that the invention is not limited to such trivial choices of implementation.

S2 indicates a locked position. Incidentally, in FIGS. 15-20, the locked position corresponds to the vertical position of the tailpiece 154 within the cross slot 389 of the tailpiece hub 380. Therefore, the angular orientation of the tailpiece 154 in FIGS. 15-20 provides a convenient visual marker indicating the position of the deadbolt 132. Also, the tailpiece 154 is not a part of the tailpiece driving assembly 300 of FIG. 15(*b*), but is helpful for reference. (The sensors S1-S4 also are not part of the tailpiece driving assembly 300, but are acted upon by the assembly 300.) As noted previously, the sensors are triggered based upon the handedness of the door at installation.

As another side note, in FIGS. 15-20, triggered sensors are illustrated either with a white bold font against a black background, or a black font illustrated against a hatched background. The difference between the former and latter draws attention to the drawing view (e.g., FIG. 15(*a*) or FIG. 15(*b*)) that best illustrates what is triggering the sensor. In other words, the drawing view with the white bold font on black background provides the better illustration of what is triggering the sensor. The top row of views draw attention to the interaction between the actuator-position-marking sensor triggers 330 and S1 and S4; the bottom row of views draw attention to the interaction between the lock-position-indicating sensor triggers 365 and S2 and S3. Sensors that are in an untriggered state are illustrated with black text against a white background.

Figure 16:
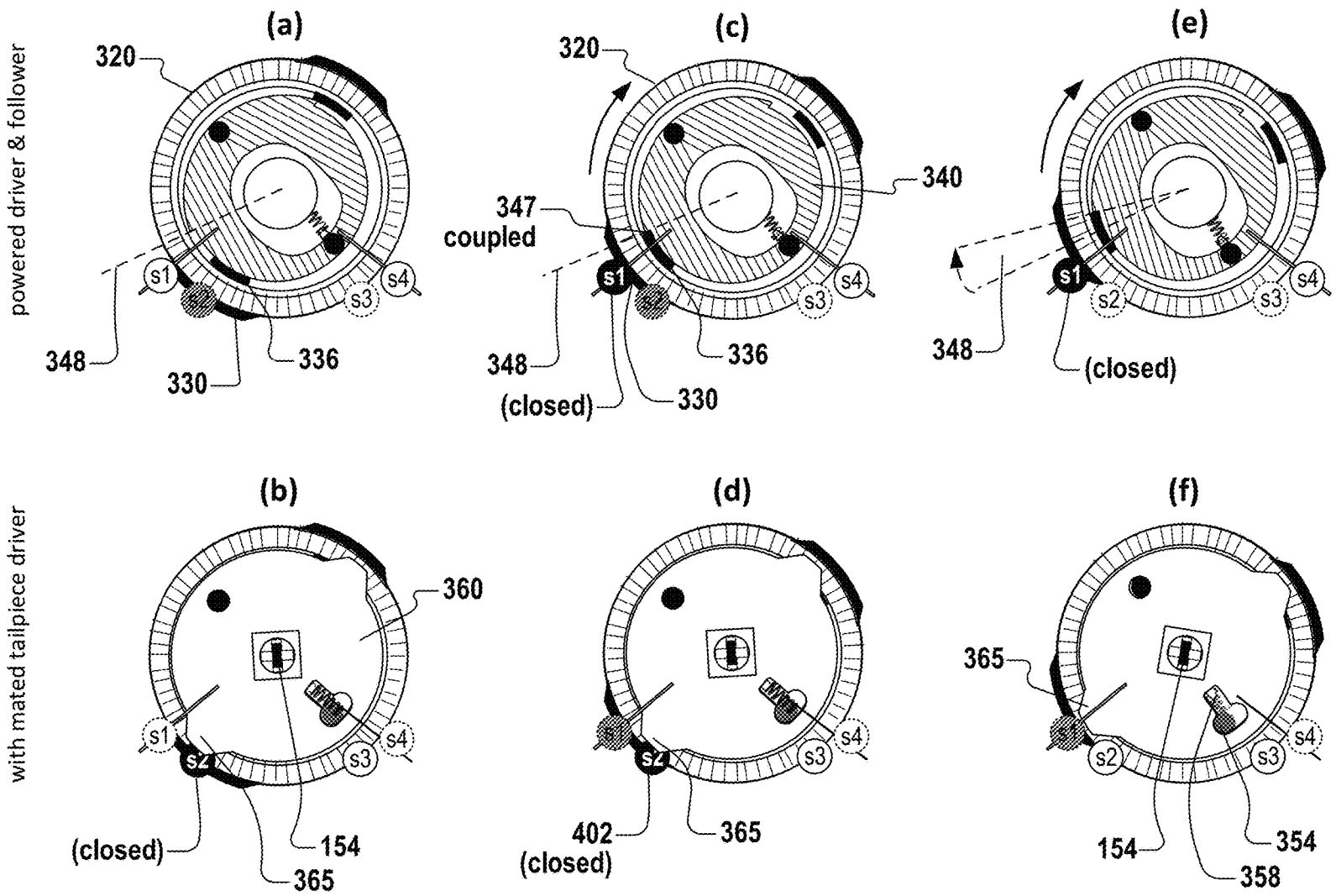
FIG. 16 is a rearward view showing three early stages of the deadbolt unlocking electronically during operation, and the changing relationship between the components of FIG. 15.
Figure 17:
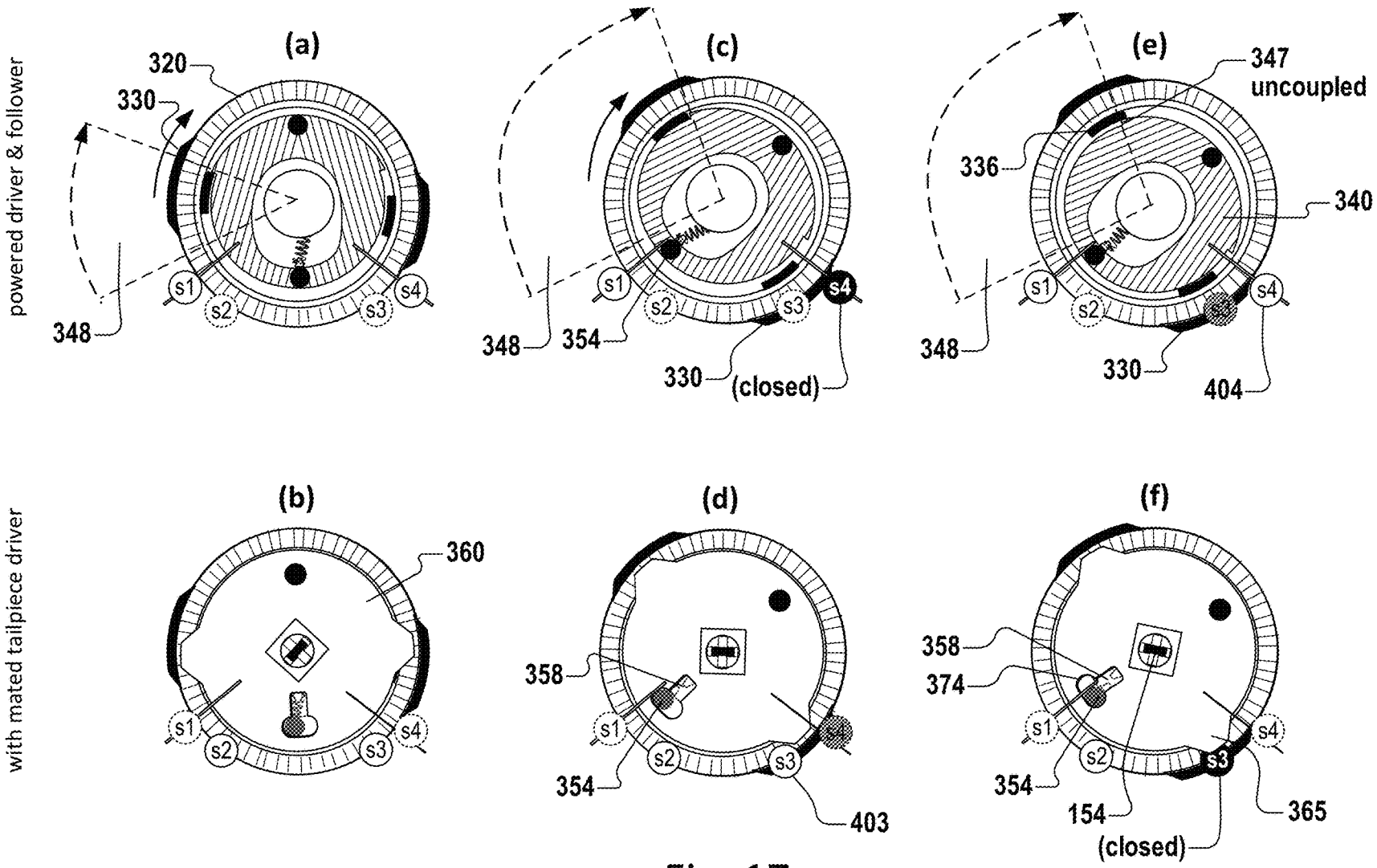
FIG. 17 is a rearward view showing three later stages of the deadbolt unlocking electronically during operation, and the changing relationship between the components of FIG. 16.

FIGS. 16 and 17 collectively illustrate six snapshots of positions during the operation of the actuator assembly 200 as it unlocks a locked deadbolt 132. Each succeeding top-and-bottom pair of views in FIG. 16 illustrate an incremental change in the orientations of one or more of the tailpiece driving assembly 300 components from a locked position. Altogether, FIGS. 16 and 17 present pairs of views of 6 progressive orientations from locked to unlocked. As with FIG. 15, the top and bottom rows are different views of the same orientation. The top row focuses on the tailpiece driving gear 320 versus the swivel disc 340. The bottom row focuses on the tailpiece driving disc 360.

FIGS. 16(*a*) and 16(*b*) illustrate a pair of views of the same components and orientation of the tailpiece driving assembly 300 as are shown in FIGS. 15(*a*) and 15(*b*), when it is installed in a right-hand door and is in a locked position, and more particularly, in a position in which the deadbolt 132 was last locked by the actuator 222. In operation, in FIG. 16(*b*) the electronic controller 490 recognizes that the lock-position-indicating sensor trigger 365 has a closed switch S2, which indicates that the deadbolt 132 is locked, a condition confirmed by the tailpiece's 154 vertical orientation.

FIGS. 16(*c*) and 16(*d*) illustrate a pair of views of the tailpiece driving assembly 300 as the actuator 222 begins the sequence of acts that will unlock the deadbolt 132. Under the power of the actuator 222, the tailpiece driving gear 320 rotates clockwise just to the point that gear catch 336 couples with disc catch 347, and before the tailpiece driving gear 320 has begun to drive the swivel disc 340. During this time, the actuator-position-indicating sensor trigger 330 closes switch S1, indicating that the lock operation has begun. The length of the sensor trigger 330 means that S1 will continue to be closed over a predetermined amount of angular travel. The controller divides this value by the length of time S1 is depressed to obtain an estimated speed of the travel. The controller also divides the additional angular travel needed to unlock the deadbolt by the detected speed to estimate of how long the actuator 222 needs to run to complete the operation. This value is, in turn, used to ensure that the actuator 222 is not caused to run too long.

FIGS. 16(*e*) and 16(*f*) illustrate a pair of views of the tailpiece driving assembly 300 shortly thereafter. The gear catch 336 has pushed the disc catch 347 to create an angle of disc catch rotation 348, as in FIG. 16(*e*). The swivel disc 340, tailpiece driving disc 360, and the tailpiece 154 with it have all begun to rotate, as illustrated in FIG. 16(*f*). Another observation—whose importance will become apparent further below—is that the bias spring 358 and pivot stop 354 are biased (relative to their position within swivel hole 374) in the direction of rotation. The lock-position-indicating sensor trigger 365 has passed beyond switch S2, which is now open. Moving to FIG. 17(*a*) the angle of disc catch rotation 348 increases until the deadbolt 132 is halfway retracted, and all switches S1-S4 are open.

FIGS. 17(*a*) and 17(*b*) illustrate a pair of views of the tailpiece driving assembly 300 when the deadbolt 132 has been halfway retracted. Now, all of the switches S1-S4 are open.

FIGS. 17(*c*) and 17(*d*) illustrate a pair of views of the tailpiece driving assembly 300 when the deadbolt has been almost completely retracted (and quite possible enough to open the door). At this point, the detent 354 has just come into contact with the clockwise stop 216. Switch S4 is closed, indicating to the controller 490 that the unlock operation is nearly completed, and enabling it, in one implementation, to modify a calculation of how long to continue operating the actuator 222. But switch S3 is not yet closed, and the operation is not yet complete. The tailpiece driving gear 320 is still coupled to the swivel disc 340 for coincident clockwise rotation. It is desirable for the swivel disk 320 to be uncoupled for three reasons: (1) so that the deadbolt can be manually locked (meaning the swivel disc 340 would rotate counterclockwise) without interference from the tailpiece driving gear 320; (2) so that the swivel disc 340 is re-oriented into a position that will enable its opposite disc catch to couple with opposite gear catch for counterclockwise (locking) rotation; and (3) so that the actuator 222 can continue to rotate in a clockwise direction under circumstances where such movement would be more energy efficient.

Figure 19:
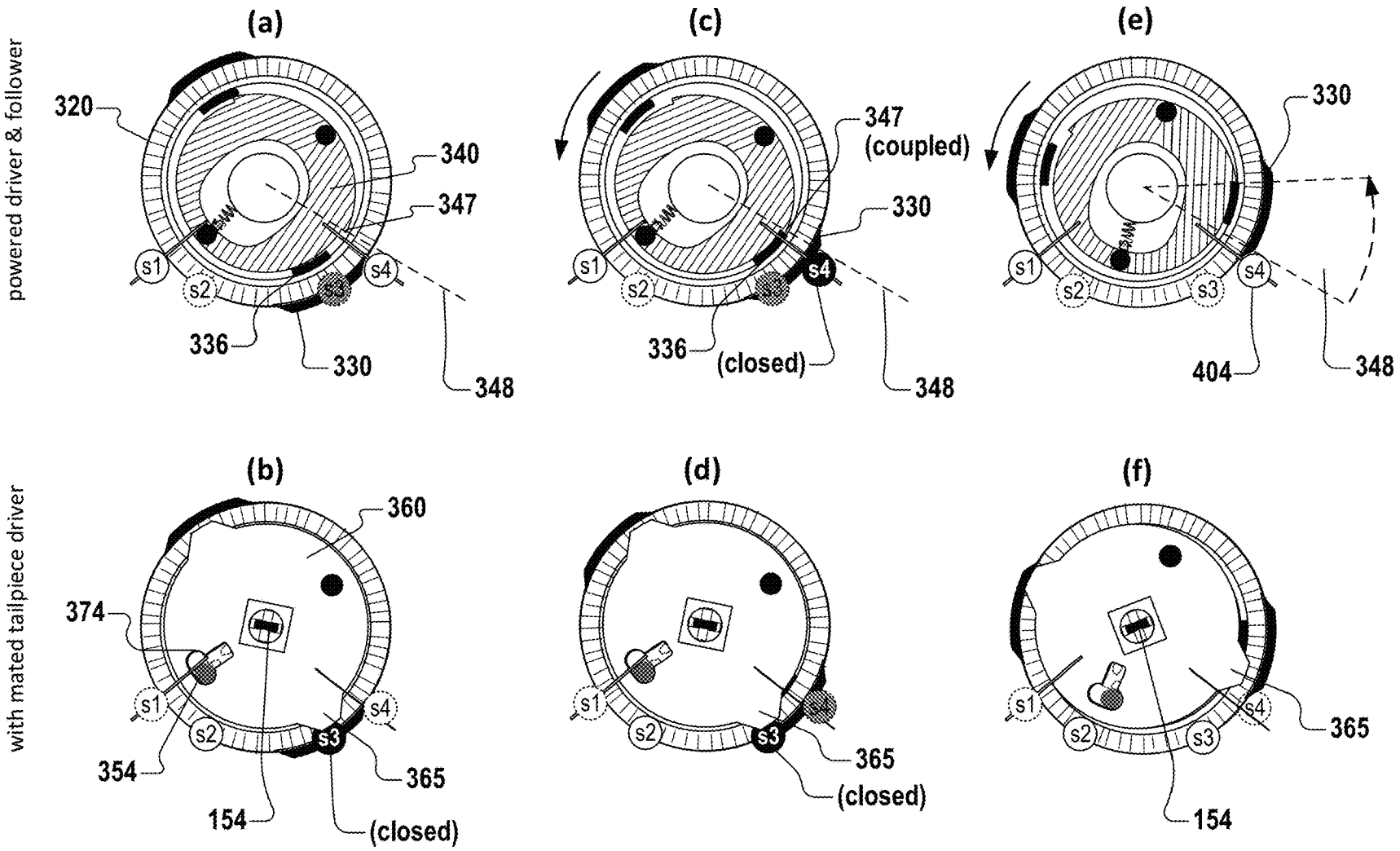
FIG. 19 is a rearward view showing three early stages of the deadbolt locking electronically during operation, and the changing relationship between the components of FIG. 15.
Figure 20:
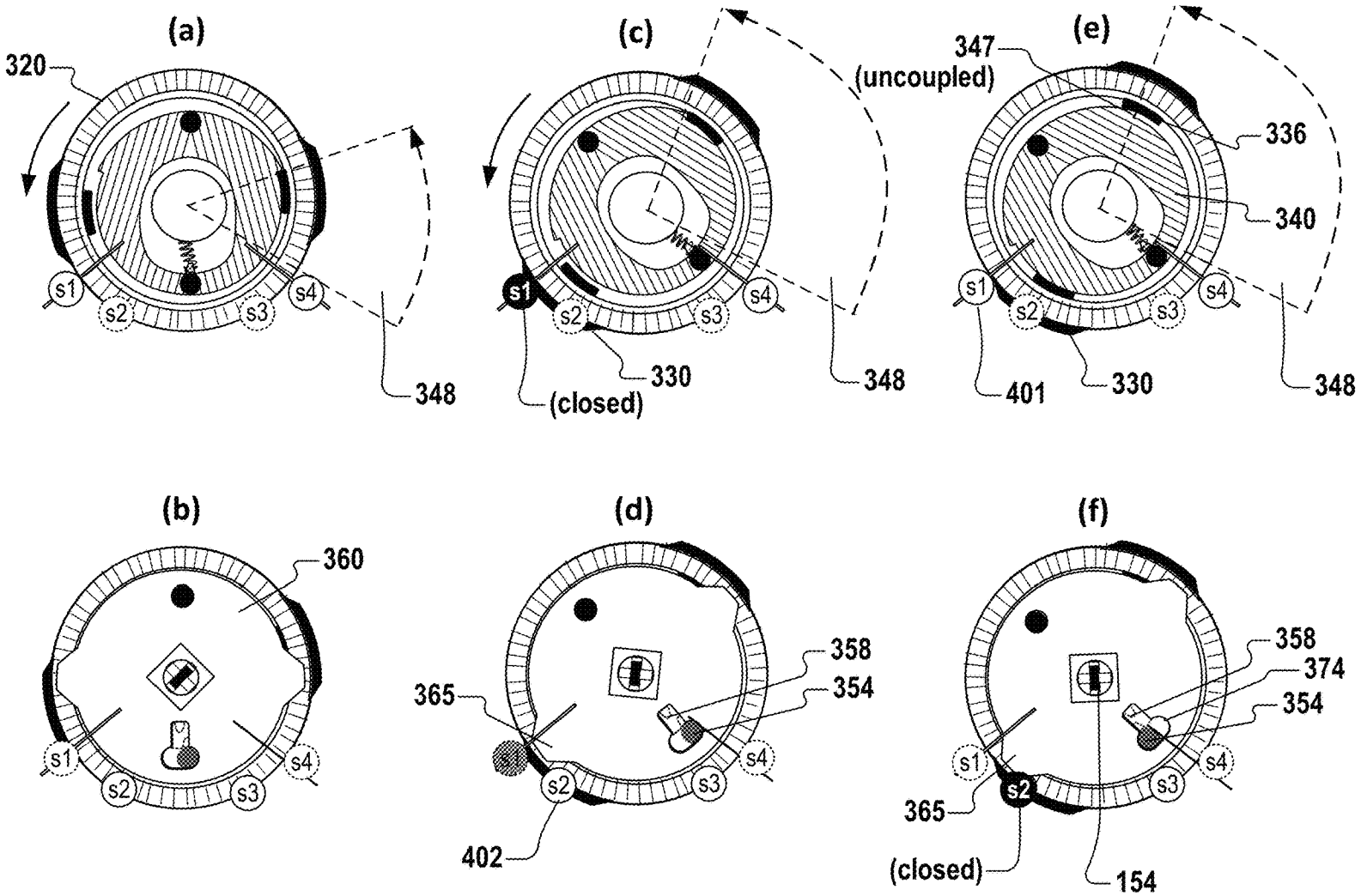
FIG. 20 is a rearward view showing three later stages of the deadbolt locking electronically during operation, and the changing relationship between the components of FIG. 19.

FIGS. 17(*e*) and 17(*f*) illustrate a final, operation-complete pair of views of the tailpiece driving assembly. After the detent 354 came into contact with the clockwise stop 216 as illustrated in FIGS. 17(*d*), further rotation causes the pivot stop 354 and the bias spring 358 to move to the opposite side of the swivel hole 374 as in FIG. 17(*f*). The movement of the swivel disc 340 to the opposite offset position with respect to the center of the tailpiece driving disc 360 allows the disc catch 347 of the swivel disc 340 to disconnect from the gear catch 336 so the gear catch 336 can pass by. Concurrently, the opposite disc catch 347 is positioned to be coupled on a future counter-clockwise journey during a locking operation, as shown in FIGS. 19 and 20. Switch S3 closes, switch S4 opens, and the unlock operation is complete.

As alluded to above, the lockset 100 of the present invention is designed to accommodate for manual operation. There is lost motion caused by the swivel disc 340 between the tailpiece driving gear 320 and the tailpiece driving disc 360 due to the fact that the swivel disc 340 is configured, at specific limits, to swivel between coupled and uncoupled positions with the tailpiece driver gear 320. This allows the tailpiece 154 to be rotated manually, after the deadbolt 132 is electronically locked or unlocked, without turning the tailpiece driving gear.

Figure 18:
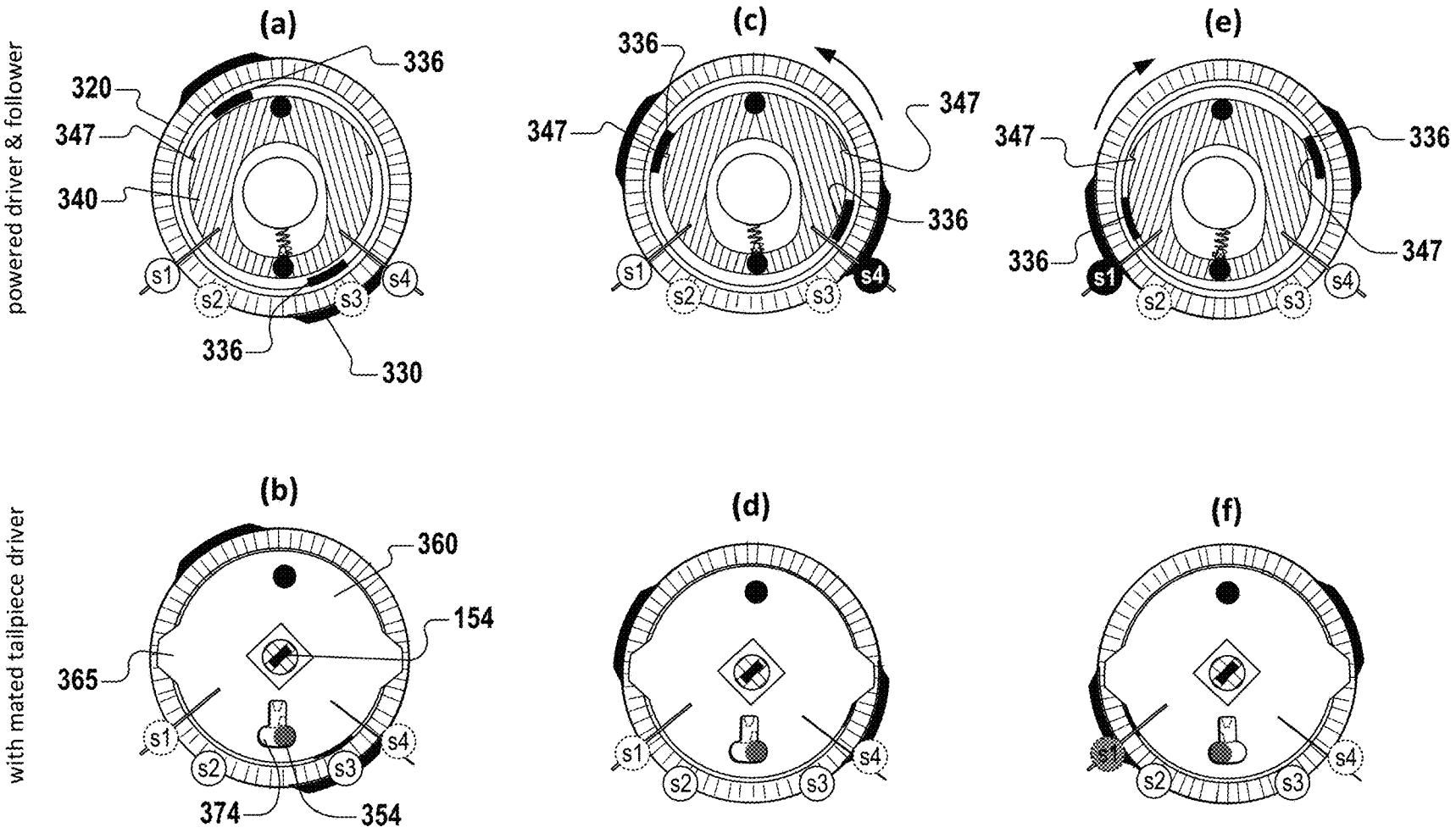
FIG. 18 is a rearward view showing progressions for locking and unlocking the deadbolt starting from a position in which the deadbolt is extended half-way after having been electronically unlocked.

FIGS. 18(*a*) and 18(*b*) illustrate a pair of views of a partially locked deadbolt 132 that has been halfway extended by manual operation after having been electronically unlocked. All switches S1-S4 are open. To completely extend the deadbolt, the controller 490 rotates the tailpiece driving gear 330 counterclockwise—as shown in FIGS. 18(*c*) and 18(*d*)—until the top left gear catch 336 rotates over the disc catch 347. It continues rotating in that direction—as illustrated in FIGS. 19 and 20—until the opposite gear catch 336 engages with disc catch 347 and begins driving the swivel disc 340. And it continues rotating counterclockwise until the tailpiece driving disc 360 is driven to its counterclockwise limit.

To completely retract the deadbolt from the position shown in FIGS. 18(*a*) and 18(*b*), the controller 490 rotates the tailpiece driving gear 330 clockwise—as shown in FIGS. 18(*e*) and 18(*f*). As it rotates clockwise, the top gear catch 336 pushes against and passes over the top right disc catch 347 shown in FIG. 18(*a*). This pushing force biases the swivel disc to the opposite offset position with respect to the center of the tailpiece driving disc 360, and positions the lower gear catch 336 for engagement with the top left disc catch 347.

Accordingly, it may be noticed that the present embodiment provides two mechanisms to toggle the swivel disc 360 between the two offset positions: (1) the moment exerted by the gear catch 336 when it presses against the disc catch 347 while the detent 354 is blocked by a smile slot limit; and (2) the moment exerted by the gear catch as it rides over the disc catch 347. It is also important to note that the second of these mechanisms reduces the amount of rotation required to operate the lockset 100.

It will also be noticed that more rotation to lock or unlock the lockset 100 is needed after the lockset 100 is manually manipulated than between two successive electronic operations of the lockset 100. Here, the controller 222 can use the information it receives from the sensor assembly 400, including memory of the last electronically-actuated lock condition (locked or unlocked), to calculate, approximately, how much extra rotation will be needed to complete a lock function that starts from a manually-operated position.

FIGS. 19 and 20 basically present the opposite operation of FIGS. 16 and 17, as the later figures illustrate six snapshots of positions during the operation of the actuator assembly 200 as it locks an unlocked deadbolt 132. In practice, at the starting position in FIG. 19(*a*) and (*b*), the electronic controller 490 senses that the lock-position-indicating sensor trigger 365 has closed switch S3, and that switch S4 is open. The door is unlocked, as indicated by the horizontal tailpiece 154. The pivot stop or detent 354 is at the left stop 216 of the smile slot 214 (not shown here) and biased to the right side of the swivel hole 374. Thus, the disc catch 347 is biased toward the inner rim of the tailpiece driving gear 320 in order to engage the gear catch 336 during rotation counterclockwise. In FIGS. 19(*c*) and (*d*), the gear catch 336 couples with the disc catch 347, and the actuator-position-marking sensor trigger 330 closes switch S4. The lock-position-indicating sensor trigger 365 has not yet moved, and switch S3 remains closed (unlocked). FIGS. 19(*e*) and (*f*) show an angle of disc catch rotation 348 equivalent to a deadbolt 132 approximately ⅛ of the way projected. Sensor triggers 330 and 365 have moved, and switches S4 and S3 are open, respectively.

Turning to FIG. 20(*a*) and (*b*), the deadbolt 132 is about halfway projected, and all switches S1-S4 are open. Rotation continues until the pivot stop 354 hits the counterclockwise or right stop 217 of the smile slot 214 (not shown here). Actuator-position-marking sensor trigger 330 closes switch S1 as the stop is met. Switch S2 is not yet closed. Further rotation of the tailpiece driving gear 320 leads to FIG. 20(*c*) and (*d*), in which the swivel disc 340 has come to a halt, its pivot stop 354 and bias spring 358 biased to the left side of the swivel hole 374. Biasing allows the gear catch 336 to slip past and uncouple from the disc catch 347, concurrently positioning the opposing disc catch 336 for a future ride in the opposite direction. The actuator-position-marking sensor trigger has moved beyond switch S1, which is now open. The lock-position-indicating sensor trigger 365 has closed switch S2. The deadbolt 132 is locked, as represented by vertical tailpiece 154. The operation is complete.

Having described FIGS. 1-20, a few useful points are added about the motor 222. The motor 222 is connected to the motor chamber 287/207 and has an output shaft that is coincident with the motor armature shaft (fit to a bevel gear 220 that coacts with the tailpiece driving gear 320) and that provides an output that is higher torque while lower speed. Maintaining a high speed on the motor 222 assures that the brushes are kept clean and capable of longevity. The time cycle of the motor 222 may be short at less than one second. Although the time cycle of the present invention is not limited, one of skill in the art will recognize the increased functionality attributed to manufacturing choices that deliver longer product life and greater reliability during operation.

In one implementation, the motor 222 is a DC powered device that operates in both clockwise and counterclockwise directions based on the polarity of the DC voltage. The motor 222 operates at a variable voltage. As a battery operated device tasked with the critical operation of controlling entry through a door, the actuator assembly 200 preferably operates equally well at a lower voltage when the batteries are nearing replacement (0.8 volts per cell) as at a voltage present when the batteries are new (1.6 volts per cell). The actuator mechanism 200 preferably accounts for variations in RPM as the voltage varies or the temperature changes.

Further, the motor-driven tailpiece driving assembly 300 operates from different starting positions, which may first be determined by an electronic controller 490, and needs to move the tailpiece driving assembly 300 different degrees of rotation dependent on the function required. The sensor assembly 400 informs the electronic controller 490 regarding the position and operation of the tailpiece driving assembly 300. Also, the electronic controller 490 has a programmable variable or hardwired setting to indicate the handing of the door (RH or LH), in order to provide the proper controls to drive the motor 222—as the handing changes, the rotation needs to be opposite. The present invention is an energy efficient, intelligent system that can take all of this into consideration.

It will be understood that the invention need not limit itself to the use of an electronic motor, or the use of gears to convert the low-torque, high-speed output of the motor to a lower-speed, higher-torque impetus on the tailpiece driving assembly 300. Also, it will be understood that the invention is not limited to the use of switches, the number of switches, or sensors that are angularly distributed across the powered driver or tailpiece driver. One of numerous alternative embodiments would employ the use of an angle sensor coupled to the tailpiece driver. Another alternative embodiment would couple a switch or other sensor to the bevel gear driving the powered driver. These are all encompassed within the scope of the invention.

It will be understood that many modifications could be made to the embodiments disclosed herein without departing from the spirit of the invention. Having thus described exemplary embodiments of the present invention, it should be noted that the disclosures contained in the drawings are exemplary only, and that various other alternatives, adaptations, and modifications may be made within the scope of the present invention. Accordingly, the present invention is not limited to the specific embodiments illustrated herein, but is limited only by the following claims.

We claim:

1. An electronic deadbolt operator for a deadbolt lockset comprising:
- a motor;
- a powered driver;
- a follower;
- a connector driver configured to be operatively connected to the deadbolt lockset;
- wherein when the electronic deadbolt operator is assembled and coupled to the deadbolt lockset:
  - the motor is operative to rotate the powered driver;
  - the powered driver is configured to couple to the follower for coincident rotation with the follower when the powered driver rotates to a first position relative to the follower;
  - the follower is coupled to the deadbolt lockset through the connector driver to drive the deadbolt between extended and retracted positions;
  - the powered driver is configured to uncouple from the follower when the follower is driven to a limit of rotation, enabling the follower and powered driver to rotate freely of each other; and
  - the connector driver is configured, when the motor is operated, to toggle the follower between a first configuration in which the powered driver is arranged to rotate the follower in a clockwise direction only, but not to rotate it in the counterclockwise direction, and a second configuration in which the powered driver is arranged to rotate the follower in the counterclockwise direction only, but not in the clockwise direction.

2. The electronic deadbolt operator of claim 1, wherein the powered driver is a gear configured to act with a rotor gear of the motor, and the follower is a swivel disc configured to be pivotally mounted to the connector driver.

3. The electronic deadbolt operator of claim 2, wherein when the electronic deadbolt operator is assembled, the powered driver is operative to engage the follower via interaction of a driver catch with a follower catch.

4. The electronic deadbolt operator of claim 3, wherein when the electronic deadbolt operator is assembled:
- the connector driver comprises a tailpiece driver disc and a tailpiece hub that is centrally mounted in the tailpiece driver disc;
- the follower is coupled to the deadbolt through the tailpiece driver disc, the tailpiece hub, and a tailpiece of the deadbolt lockset that is mounted in the tailpiece hub slot.

5. The electronic deadbolt operator of claim 2, wherein the powered driver includes a recess configured to seat the follower and enable the driver to rotate the follower when the follower is coupled to the driver and to enable the follower to move between the first and second configurations.

6. The electronic deadbolt operator of claim 1, wherein:
- the follower has a clockwise limit of rotation and a counterclockwise limit of rotation; and
- the follower is toggled when effort to rotate the follower to the clockwise or counterclockwise limit of rotation overcomes a spring bias between the follower and the connector driver, causing the follower to swivel from the first or second configuration to the opposite configuration, uncoupling the follower from the powered driver.

7. An electronic deadbolt operator for a deadbolt lockset comprising:
- a motor;
- a powered driver; and
- a follower;
- a connector driver;
- wherein when the electronic deadbolt operator is assembled and coupled to the deadbolt lockset:
  - the motor is operative to rotate the powered driver;
  - the powered driver is configured to couple to the follower for coincident rotation with the follower when the powered driver rotates to a first position relative to the follower;
  - the follower is coupled to the deadbolt lockset through the connector driver to drive a deadbolt between extended and retracted positions; and
  - the follower is pivotally mounted to the connector driver to swivel between oppositely disposed left and right offset-from-center positions; and
  - the powered driver and follower are respectively configured to become decoupled when the follower is driven to a limit of rotation, enabling the powered driver to rotate freely of the follower.

8. The electronic deadbolt operator of claim 7, wherein the follower, when swiveled to the right offset-from-center position, is oriented to catch clockwise rotation of the powered driver and escape counterclockwise rotation of the powered driver, and when swiveled to the left offset-from-center position, is oriented to catch counterclockwise rotation of the powered driver and escape clockwise rotation of the powered driver.

9. The electronic deadbolt operator of claim 7, further comprising a spring that, when the electronic deadbolt operator is assembled, biases the follower to either the left offset-from-center position or the right-offset-from-center position, the spring force creating a hysteresis that resists swiveling between the left-biased and right-biased offset positions.

10. The electronic deadbolt operator of claim 7, further comprising stops that, when the electronic deadbolt operator is assembled, limit range of travel of the follower in relation to the door.

11. The electronic deadbolt operator of claim 10, wherein after force is exerted by the powered driver to rotate the follower into contact with one of the stops, continued force in the same angular direction causes the follower to swivel from its existing offset-from-center position to the opposite offset-from-center position.

12. The electronic deadbolt operator of claim 7, wherein, when the electronic deadbolt operator is assembled:

the follower is pivotally connected to the connector driver at a pivot point that is offset from a center of rotation of the connector driver;

the follower is loosely coupled to the connector driver via a swivel guide that is positioned on an opposite side of the center of rotation from the pivot point; and the swivel guide defines an extent to which the follower can pivot in relation to the connector driver.

13. The electronic deadbolt operator of claim 12, wherein the pivotal connection between the follower and the connector driver is provided by a pin that projects from the follower into a corresponding pivot pin hole in the connector driver.

14. The electronic deadbolt operator of claim 12, wherein the swivel guide comprises a slot.

15. An electronic deadbolt operator for a deadbolt lockset comprising:

a motor;

a powered driver;

a follower; and a connector driver configured to be operatively connected to the deadbolt lockset;

wherein when the electronic deadbolt operator is assembled and coupled to the deadbolt lockset:

the motor is operative to rotate the powered driver in either a clockwise direction or a counterclockwise direction;

the follower is coupled through the connector driver to the deadbolt lockset to drive the deadbolt between extended and retracted positions; and the follower is configured to toggle between first and second configurations relative to the powered driver, wherein:

in the first configuration clockwise rotation of the powered driver to a first position relative to the follower couples the powered driver to the follower for coincident rotation in the clockwise direction;

in the second configuration counterclockwise rotation of the powered driver to a second position relative to the follower couples the powered driver to the follower for coincident rotation in the counterclockwise direction;

in the first configuration, counterclockwise rotation of the powered driver is not effective to couple the powered driver to the follower for coincident rotation in the counterclockwise direction;

in the second configuration, clockwise rotation of the powered driver is not effective to couple the powered driver to the follower for coincident rotation in the clockwise direction.

16. The electronic deadbolt actuator of claim 15, further comprising:

a clockwise stop that limits rotation of the follower past a clockwise rotational limit and that, when the follower is urged to continue rotating in the clockwise direction, toggles the follower from the first configuration to the second configuration;

a counterclockwise stop that limits rotation of the follower from rotating past a counterclockwise rotational limit and that, when urged to continue rotating in the counterclockwise direction, toggles the follower from the second configuration to the first configuration.

17. The electronic deadbolt actuator of claim 16, wherein the clockwise stop and counterclockwise stop are incorporated into the connector driver.

18. An electronic deadbolt operator for a deadbolt lockset comprising:

a motor;

a powered driver;

a follower;

a connector driver configured to be operatively connected to the deadbolt lockset; and a spring;

wherein when the electronic deadbolt operator is assembled and coupled to the deadbolt lockset:

the motor is operative to rotate the powered driver;

the powered driver is configured to couple to the follower for coincident rotation with the follower when the powered driver rotates to a first position relative to the follower;

the follower is coupled through the deadbolt operator to a deadbolt to drive the deadbolt between extended and retracted positions;

the follower is configured for pivotal movement between first and second spring-biased positions about a pivot point that is displaced from an axis of rotation of the powered driver; and when the follower is driven to a limit of rotation, the powered driver is configured to overcome a spring bias causing the follower to remain in one of the first and second positions and translate the follower to another of the first and second positions, which uncouples the follower from the powered driver, enabling the follower and powered driver to rotate freely of each other.

* * * * *